US010463906B2

(12) United States Patent
Owusu

(10) Patent No.: US 10,463,906 B2
(45) Date of Patent: Nov. 5, 2019

(54) EXERCISE DEVICES, SYSTEMS, AND METHODS

(71) Applicant: JAXAMO LTD, Bedfordshire (GB)

(72) Inventor: Stephen Owusu, Newcastle, WA (US)

(73) Assignee: JAXAMO LTD. (GB)

( * ) Notice: Subject to any disclaimer, the term of this patent is extended or adjusted under 35 U.S.C. 154(b) by 0 days.

(21) Appl. No.: 16/160,399

(22) Filed: Oct. 15, 2018

(65) Prior Publication Data

US 2019/0240526 A1 Aug. 8, 2019

Related U.S. Application Data

(63) Continuation-in-part of application No. 15/887,278, filed on Feb. 2, 2018, now Pat. No. 10,099,083.

(51) Int. Cl.
*A63B 21/075* (2006.01)
*A63B 24/00* (2006.01)
(Continued)

(52) U.S. Cl.
CPC ..... *A63B 21/075* (2013.01); *A63B 21/00065* (2013.01); *A63B 21/0724* (2013.01);
(Continued)

(58) Field of Classification Search
CPC ..... A63B 2024/0081; A63B 21/075; A63B 21/4035; A63B 23/12; A63B 71/0619; A63B 71/0054; A63B 24/0062; A63B 24/0087; A63B 2225/50; A63B 21/00; A63B 21/00058; A63B 21/00065; A63B 21/06; A63B 21/0605; A63B 21/072;
(Continued)

(56) References Cited

U.S. PATENT DOCUMENTS 5,876,313 A 3/1999 Krull
6,033,350 A 3/2000 Krull
(Continued)

FOREIGN PATENT DOCUMENTS

CN 201823224 U 5/2011
EP 2269701 A2 1/2011
TW M534015 U 12/2016

OTHER PUBLICATIONS

Design U.S. Appl. No. 29/635,801, filed Feb. 2, 2018—36 pages.
(Continued)

*Primary Examiner* — Megan Anderson
(74) *Attorney, Agent, or Firm* — RatnerPrestia

(57) ABSTRACT

Exercise devices, systems, and methods are disclosed. One exercise device includes weights, a shell assembly, and a base assembly. The shell assembly has a shell defining an interior sized to receive the weights. The shell assembly also has a shaft coupled for rotation relative to the shell. When the weights are received within the interior of the shell, rotation of the shaft relative to the shell selectively couples the shaft with one or more weights. The base assembly has a base configured to support the weights. The base assembly also has a driver configured to be coupled to the shaft when the shell assembly is supported by the base. The driver of the base assembly is configured to rotate the shaft relative to the shell when the driver is coupled to the shaft to selectively couple the shaft with the one or more weights.

13 Claims, 27 Drawing Sheets

(51) Int. Cl.
*A63B 21/00* (2006.01)
*A63B 21/072* (2006.01)

(52) U.S. Cl.
CPC ..... *A63B 21/0726* (2013.01); *A63B 21/4035* (2015.10); *A63B 24/0087* (2013.01); *A63B 2225/52* (2013.01)

(58) Field of Classification Search
CPC ..... A63B 21/0728; A63B 21/0724; A63B 21/0726; A63B 2225/52
See application file for complete search history.

(56) References Cited

U.S. PATENT DOCUMENTS 6,186,927 B1 2/2001 Krull
6,322,481 B1 11/2001 Krull
6,402,666 B2 6/2002 Krull
6,416,446 B1 7/2002 Krull
6,422,979 B1 7/2002 Krull
6,540,650 B1 4/2003 Krull
6,629,910 B1 10/2003 Krull
6,669,606 B2 12/2003 Krull
6,679,816 B1 1/2004 Krull
6,733,424 B2 5/2004 Krull
6,746,381 B2 6/2004 Krull
6,749,547 B2 6/2004 Krull
D500,820 S 1/2005 Krull
6,855,097 B2 2/2005 Krull
6,899,661 B1 5/2005 Krull
6,974,405 B2 12/2005 Krull
7,077,790 B1 7/2006 Krull
D528,173 S 9/2006 Flick et al.
D528,611 S 9/2006 Flick et al.
7,128,697 B1 10/2006 Krull
7,137,932 B2 11/2006 Doudiet
7,153,243 B1 12/2006 Krull
D536,752 S 2/2007 Walkerdine
D540,405 S 4/2007 Crawford et al.
D540,894 S 4/2007 Crawford et al.
7,223,214 B2 5/2007 Chen
7,261,678 B2 8/2007 Crawford et al.
7,264,578 B1 9/2007 Krull
7,377,885 B2 5/2008 Doudiet
7,387,596 B2 6/2008 Towley, III et al.
7,387,597 B2 6/2008 Krull
7,485,077 B2 2/2009 Chen
7,497,814 B1 3/2009 Krull
7,520,845 B2 4/2009 Towley, III et al.
7,534,199 B2 5/2009 Krull
7,547,268 B1 6/2009 Krull
7,578,771 B1 8/2009 Towley, III et al.
7,614,982 B2 11/2009 Crawford et al.
7,614,983 B1 11/2009 Krull
7,621,855 B1 11/2009 Krull
7,648,448 B2 1/2010 Krull
D610,636 S 2/2010 Golesh et al.
7,762,933 B1 7/2010 Yu
7,794,373 B2 9/2010 Crawford et al.
D639,358 S 6/2011 Rauwerdink
D639,359 S 6/2011 Rauwerdink
7,976,443 B2 7/2011 Krull
7,981,012 B1 7/2011 Krull
7,981,013 B2 7/2011 Krull
D643,481 S 8/2011 Rauwerdink
8,002,680 B2 8/2011 Crawford et al.
8,021,282 B2 9/2011 Polevoy et al.
8,137,248 B1 3/2012 Krull
8,287,438 B2 10/2012 Krull
8,696,529 B2 4/2014 Krull
8,771,153 B2 7/2014 Dalebout et al.
8,784,280 B2 7/2014 Krull
8,784,283 B2 7/2014 Svenberg
9,011,299 B2 4/2015 Lien
9,022,907 B2 5/2015 Wang
D737,907 S 9/2015 Flick
9,375,602 B2 6/2016 Krull
9,604,092 B2 3/2017 Krull
9,616,271 B2 4/2017 Svenberg
9,776,032 B2 10/2017 Moran et al.
9,814,922 B2 * 11/2017 Moran ..... A63B 21/075
10,195,477 B2 * 2/2019 Marjama ..... A63B 71/0036
2007/0135274 A1 6/2007 Blateri
2008/0081744 A1 4/2008 Gormley
2015/0273272 A1 10/2015 Wang
2015/0360073 A1 12/2015 Moran et al.
2015/0367164 A1 12/2015 Myre
2016/0059064 A1 3/2016 Smith et al.
2016/0089559 A1 3/2016 Smith et al.
2016/0089560 A1 3/2016 Smith et al.
2016/0089575 A1 3/2016 Smith et al.
2016/0184623 A1 6/2016 Moran et al.
2017/0001061 A1 1/2017 Marjama et al.
2017/0072244 A1 3/2017 Svenberg
2017/0072245 A1 3/2017 Svenberg
2017/0239510 A1 8/2017 Wang
2018/0036578 A1 2/2018 Moran et al.
2018/0264308 A1 * 9/2018 Wang ..... A63B 21/0726
2018/0353794 A1 * 12/2018 Wang ..... A63B 21/075

OTHER PUBLICATIONS

Invitation to Pay Additional Fees with Partial International Search for International Application No. PCT/EP2019/052491, dated May 7, 2019, 12 pages.
International Search Report and Written Opinion for International Application No. PCT/EP2019/052491, dated Jun. 28, 2019, 18 pages.

* cited by examiner 513
570
580
576
548
546
540
559
531
544a
544b
572
582
582'
584
584'
585
587
583
510
511
512
B
A
14F
14E
500

EXERCISE DEVICES, SYSTEMS, AND METHODS

CROSS REFERENCE TO RELATED APPLICATIONS

This application is a continuation-in-part of copending application Ser. No. 15/887,278, filed Feb. 2, 2018, for which this application claims benefit and priority, the disclosure of which is incorporated herein by reference in its entirety for all purposes.

FIELD OF THE INVENTION

The present invention relates generally to weight training exercise, and more particularly, to adjustable weight exercise devices, systems, and methods.

BACKGROUND OF THE INVENTION

Conventionally, weight training exercises may be performed with free weight devices, such as dumbbells, kettlebells, or the like. These free weight devices may have a fixed weight, or may allow a user to adjust their weight through the manual addition or removal of weights.

Adjusting the weight on a free weight device may interfere with weight training by causing a substantial pause in or disruption to the user's desired training activity. Accordingly, improved devices, systems, and methods are desired for adjusting the weight of exercise equipment.

SUMMARY OF THE INVENTION

Aspects of the present invention are related to exercise devices, systems, and methods.

In accordance with one aspect of the present invention, an exercise device includes a plurality of weights, a shell assembly, and a base assembly. The weights are configured to be positioned adjacent, one another. The shell assembly has a shell defining an interior sized to receive the weights. The shell assembly also has a shaft coupled for rotation relative to the shell and extending within the interior of the shell. When the weights are received within the interior of the shell, rotation of the shaft relative to the shell selectively couples the shaft with one or more of the weights. The base assembly has a base configured to support the weights and the shell assembly. The base assembly also has a driver configured to be coupled to the shaft of the shell assembly when the shell assembly is supported by the base. The driver is also configured to be decoupled from the shaft of the shell assembly when the shell assembly is not supported by the base. The driver of the base assembly is configured to rotate the shaft of the shell assembly relative to the shell of the shell assembly when the driver is coupled to the shaft of the shell assembly to selectively couple the shaft with the one or more of the weights.

In accordance with another aspect of the present invention, an exercise method includes positioning a shell assembly on a base assembly having a plurality of weights positioned on it, such that the weights are received within an interior of a shell of the shell assembly; rotating a shaft of the shell assembly relative to the shell with a driver of the base assembly coupled to the shaft to selectively couple the shaft with one or more of the weights; and lifting the shell assembly off of the base assembly with the one or more of the weights coupled with the shaft of the shell assembly and with the one or more of the weights within the interior of the shell.

In accordance with yet another aspect of the present invention, an exercise system includes a plurality of exercise devices. Each exercise device has a plurality of weights configured to be positioned adjacent one another, a shaft configured for rotation relative to the weights, wherein rotation of the shaft relative to the weights selectively couples the shaft with one or more of the weights, a base assembly having a base configured to support the weights and a driver configured to be coupled to and decoupled from the shaft, and a communication device configured to wirelessly communicate with the communication device of another one of the exercise devices. The driver of one of the exercise devices is configured to rotate the shaft of the one of the exercise devices based on data received from the communication device of another one of the exercise devices.

In accordance with still another aspect of the present invention, an exercise device includes a plurality of weights, a shaft, a base assembly, and an input device. The weights are configured to be positioned adjacent one another. The shaft is configured to engage with one or more of the weights. The base assembly has a driver configured to be coupled to and decoupled from the shaft. The input device is associated with the shaft or the base assembly. The input device is configured to receive an input from a user of the exercise device. The input includes a selection of a number of the weights. The driver of the base assembly is configured to automatically move the shaft relative to the weights when the driver is coupled to the shaft and when the input is received by the input device to selectively engage the shaft with the selected number of weights.

In accordance with still another aspect of the present invention, the exercise device includes a plurality of weights configured to be positioned adjacent one another. A shell assembly has a shell defining an interior, the shell assembly also having a shaft coupled for movement relative to the shell and extending within the interior of the shell, wherein movement of the shaft relative to the shell selectively couples the shaft with one or more of the plurality of weights. A base assembly has a base configured to support the plurality of weights and the shell assembly. The base assembly also has a driver configured to be coupled to the shaft of the shell assembly when the shell assembly is supported by the base. The driver also being configured to be decoupled from the shaft of the shell assembly when the shell assembly is not supported by the base. The driver of the base assembly is configured to move the shaft of the shell assembly relative to the shell of the shell assembly when the driver is coupled to the shaft of the shell assembly to selectively couple the shaft with the one or more of the plurality of weights.

In accordance with still another aspect of the present invention, an exercise method includes the steps of: positioning a shell assembly on a base assembly having a plurality of weights positioned thereon; moving a shaft of the shell assembly relative to the shell with a driver of the base assembly coupled to the shaft to selectively couple the shaft with one or more of the plurality of weights; and lifting the shell assembly off of the base assembly with the one or more of the plurality of weights coupled with the shaft of the shell assembly.

BRIEF DESCRIPTION OF THE DRAWINGS

The invention is best understood from the following detailed description when read in connection with the accompanying drawings. When a plurality of similar elements are present, a single reference numeral may be assigned to the plurality of similar elements with a small letter designation referring to specific elements. When referring to the elements collectively or to a non-specific one or more of the elements, the small letter designation may be dropped. It is emphasized that, according to common practice, the various features of the drawings are not necessarily to scale. On the contrary, the dimensions of the various features may be arbitrarily expanded or reduced for clarity. Included in the drawings are the following figures:

Specifically, FIG. 18A is another front elevation view of the exemplary exercise device of FIGS. 14A-14E.

FIG. 18B is a top plan view of the exemplary exercise device of FIG. 18A.

FIG. 18C depicts a cross-sectional side view of the device of FIG. 18A taken along the lines 18C-18C.

FIG. 18D depicts a cross-sectional side view of the device of FIG. 18A taken along the lines 18D-18D.

FIG. 18E depicts a cross-sectional side view of the device of FIG. 18A taken along the lines 18E-18E.

FIG. 18F depicts a cross-sectional side view of the device of FIG. 18B taken along the lines 18F-18F.

DETAILED DESCRIPTION OF THE INVENTION

Figure 1A:
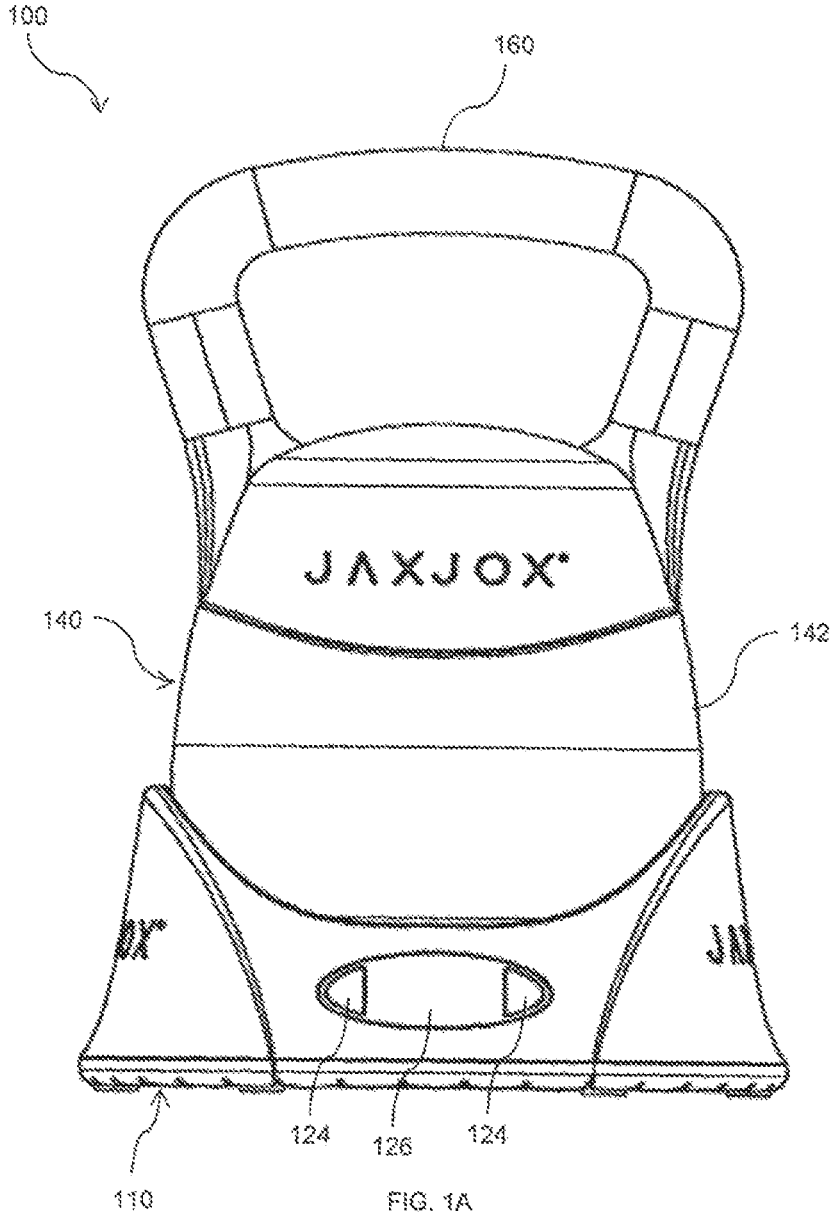
FIGS. 1A-1C depict an exemplary exercise device in accordance with aspects of the present invention.

Although the invention is illustrated and described herein with reference to specific embodiments, the invention is not intended to be limited to the details shown. Rather, various modifications may be made in the details within the scope and range of equivalents of the claims and without departing from the invention.

The exemplary exercise systems, methods, and devices disclosed herein are principally described with respect to kettlebells and dumbbells. However, it will be understood by one of ordinary skill in the art that the invention is not so limited. To the contrary, the disclosed concepts, features, and embodiments may be usable with any type of weight device without departing from the spirit or scope of the present invention, including, for example, barbells, medicine balls, or other free weights and weight systems.

The exemplary systems, devices, and methods disclosed herein may be usable by an individual user as part of one or a series of weight training exercises. In such uses, the disclosed embodiments may allow the individual user to select a desired weight for the weight training exercise, and/or adjust the weight of the exercise device before, during, or after a weight training exercise.

Additionally, the exemplary systems, devices, and methods disclosed herein may be usable by groups of users as part of a coordinated weight training exercise. Such groups of users may be co-located at a single location or remotely located and connected by technology in a virtual group. In such use, whether the users are co-located or in a virtual group, the disclosed embodiments may allow an individual user in the group to select a desired weight for the weight training exercise, and automatically communicate that desired weight to the exercise systems or devices of other individuals in the group. The desired weight may further be automatically selected at the exercise systems or devices of one or more of the individuals in the group.

Alternatively, the exemplary systems, devices, and methods disclosed herein may be usable by an individual user alone without connection to other systems or devices. Accordingly, the usage of the systems, devices, and methods is scalable.

Referring now to the drawings, FIGS. 1A-1C, 2A, and 2B illustrate an exemplary exercise device or apparatus 100 in accordance with aspects of the present invention. Exercise device 100 may be, for example, provided in the form of a kettlebell. As a general overview, device 100 includes a base assembly 110, a shell assembly 140, and a plurality of weights 170. Additional details of device 100 are described below.

Base assembly 110 provides support for the components of device 100. Base assembly 110 has a housing 112 which houses certain components of device 100. Housing 112 may include one or more exterior surfaces on which other components of device 100 may rest.

As shown in FIGS. 2A, 2B, 3A and 3B, housing 112 of base assembly 110 may include a first surface 114 and a second surface 116 on an upper portion thereof. Surfaces 114 and 116 form a base configured to support shell assembly 140 and weights 170. In particular, surface 114 may be configured to support weights 170, e.g., in a stacked orientation, and surface 116 may be configured to support shell assembly 140, e.g., at a lower surface thereof. In this example, surface 116 surrounds first surface 114. Surface 116 may be formed at a same level as surface 114, or may be provided at a level above or below the level of surface 114.

Base assembly 110 may further include one or more guide walls 118 and guide projections 119. Guide walls 118 extend upward from surface 116 to assist the user of device 100 in aligning shell assembly 140 on base assembly 110. Guide projections 119 extend upward from surface 114 to assist the user of device 100 in aligning weights 170 on base assembly 110.

Base assembly 110 houses a driver 120. Driver 120 is configured to be coupled to and decoupled from a shaft 150 of shell assembly 140, as will be described in greater detail below. Driver 120 is further configured to move, e.g. rotate, the shaft 150 of shell assembly 140. In an exemplary embodiment, driver 120 comprises a motor, such as a brushless electric motor. Suitable motors for use as driver 120 will be known from the description herein.

Base assembly 110 may further comprise a controller 122. Controller 122 electrically controls driver 120 to operate, e.g., to rotate, shaft 150 when shaft 150 is coupled to driver 120. As will be discussed in greater detail below, controller 122 may operate driver 120 automatically, or in response to some input, e.g., input from a user of exercise device 100 or a transmission from another exercise device 100.

Controller 122 may be in communication with a sensor 123. Sensor 123 is configured to detect when driver 120 is coupled, to or decoupled from shaft 150 of shell assembly 140. Controller 122 may thus operate driver 120 only when sensor 123 signals that driver 120 is coupled to shaft 150 or that one or more surfaces of the base assembly 110, such as surfaces 114 and/or 116, support or are adjacent to the shell assembly 140 and/or weights 170. Suitable sensors for use as sensor 123 include, for example, optical sensors, pressure sensors, or electrical sensors.

Base assembly 110 may further comprise an input device 124. Input device 124 receives input from a user of exercise device 100. Input device 124 is electrically and/or mechanically coupled to driver 120 to cause driver 120 to rotate shaft 150 based on input by the user of exercise device 100. The input may comprise a selection of a type of weight training exercise, an amount of weight, or a number of weights 170. Controller 122 may then control driver 120 based on the type of weight training exercise, an amount of weight, or a number of weights 170 received by input device 124.

The form of input device 124 is not intended to be limited. Input device 124 may be configured to receive a mechanical input, e.g., a knob, dial, button, slider, or other structure, adapted to be directly manipulated or moved by the user of exercise device 100. Input device 124 may be configured to receive an electrical or electronic input, e.g., a key, touch-screen, or touchpad, or other structure, adapted to generate a mechanical signal in response to a user interaction. Other structures suitable for use as input device 124 will be known from the description herein.

Along with input device 124, base assembly 110 may further comprise a display 126. Display 126 is configured to display the input provided by the user to input device 124, e.g., the selected exercise, amount of weight, or selected number of weights 170. Suitable displays for use as display 126 include, for example, liquid crystal displays or light emitting diode displays. Other displays will be known from the description herein.

Base assembly 110 may further comprise a communication device 128. Communication device 128 may be configured to wirelessly communicate with another exercise device 100, and/or with other wireless transceivers, as discussed in greater detail below. Data received via communication device 128 may be used to control the operation of driver 120, as described in greater detail below.

While input device 124 and display 126 are described as being associated with and/or housed by base assembly 110, it will be understood that the invention is not so limited. For example, sensor 123, input device 124, and/or display 126 may be provided on shell assembly 140. In one embodiment, sensor 123, input device 124, and display 126 are provided on an exterior surface of shell 142. In this embodiment, sensor 123 and/or input device 124 may communicate the user input to the driver 120 in base assembly 110 by wireless communication, or by way of a wired communication interface which is created when shell assembly 140 is placed on base assembly 110. Where sensor 123 is provided on the exterior surface of shell 142, sensor 123 may be provided with a sensor cover 129 to protect sensor 123 from an external environment.

Alternatively, device 100 may not include a display 126. In such embodiments, the information to be presented by display 126 may be presented with a remote device (e.g., on a smartphone or tablet display or monitor of the user) which is in wired or wireless communication with device 100.

A power supply 130 (such as a rechargeable battery) may be provided in base assembly 110 or shell assembly 140 for powering the electrical components of device 100. Alternatively, device 100 may be provided with power through one or more power/communication terminals 132 formed on base assembly 110 or via a port or cable connection. Device 100 may be configured to be primarily powered through terminals 132, or may use power connections through terminals 132 for recharging power supply, e.g., when power supply 130 is a rechargeable battery. Other sources of power can optionally be selected as well.

Figure 1B:
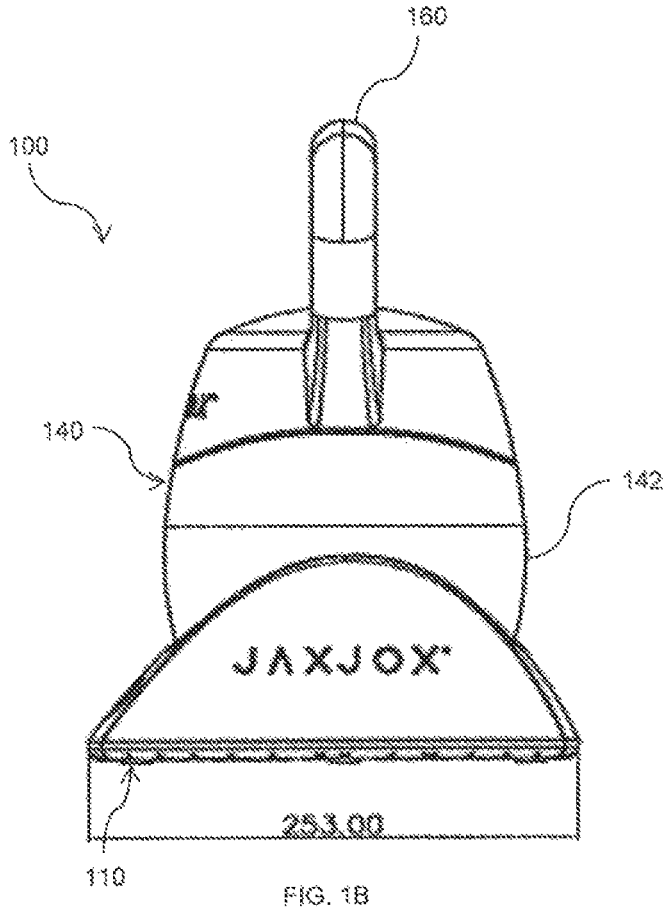
Figure 1C:
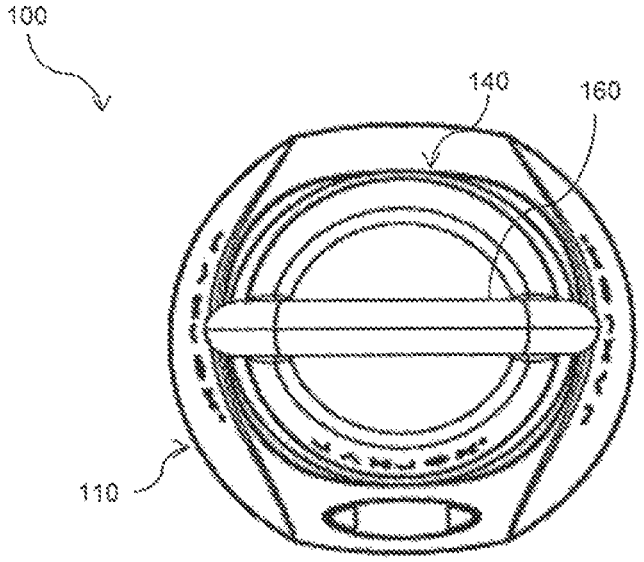

Shell assembly 140 is grasped and lifted by a user of device 100. As shown in FIGS. 1A-1C, shell assembly 140 may have the shape of a kettlebell. However, it will be understood that the shape of shell assembly 140 is not limited, and shell assembly 140 may be configured as any type of free weight device.

Figure 2A:
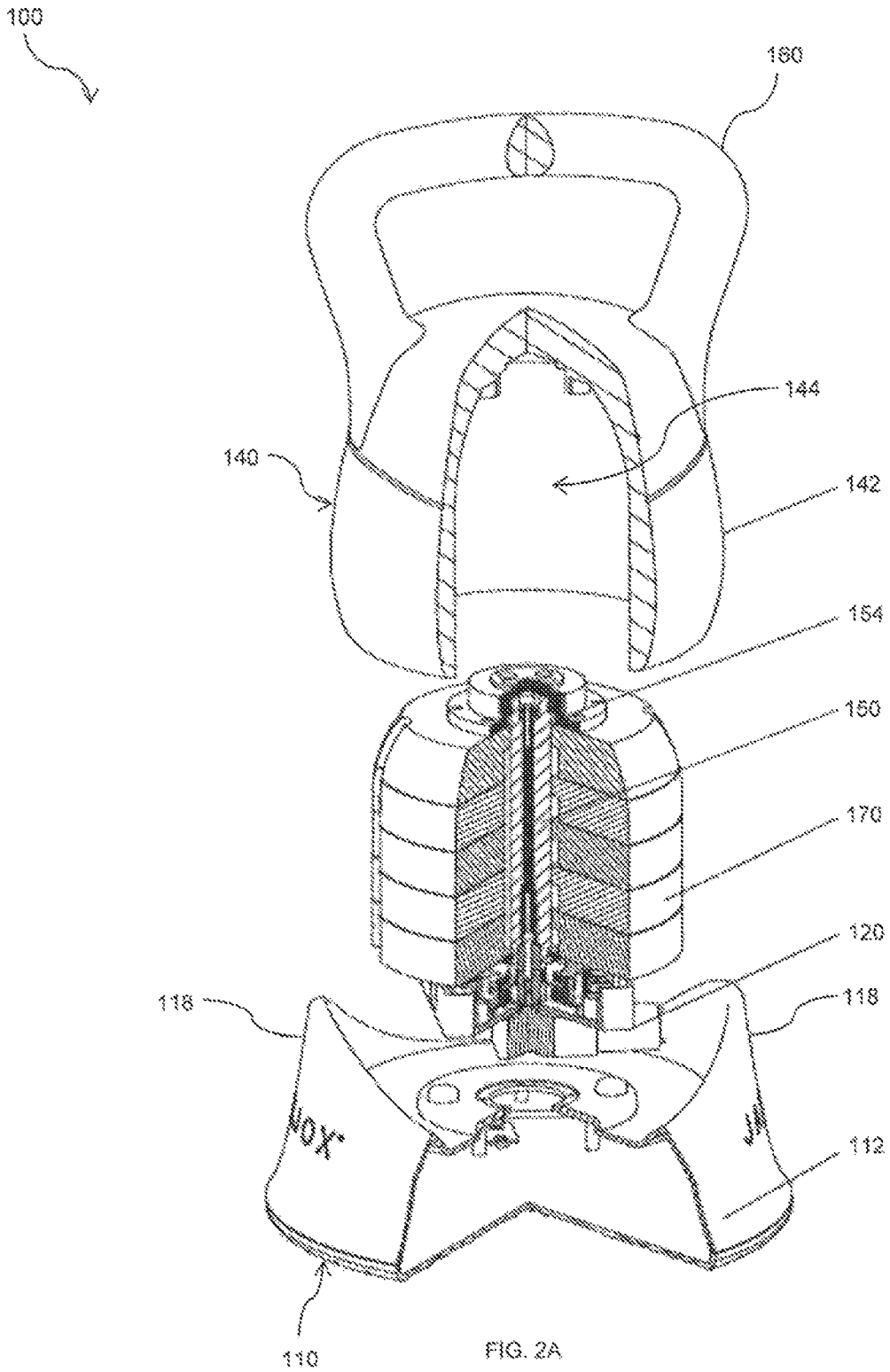
FIGS. 2A and 2B depict exploded views of the exercise device of FIGS. 1A-1C.

As shown in FIGS. 2A, 2B, and 4A-4C, shell assembly 140 includes a shell 142. Shell 142 defines an interior space 144, which is sized to receive weights 170. Shell 142 and interior space 144 have a shape and size selected to correspond to the shape and size of weights 170. For example, shell 142 and interior space 144 may have a generally circular cross-section, as shown in FIG. 2A, or any other shape to match that of a shell or support that may not have a circular cross-section. Interior space 144 of shell 142 may further include one or more ridges 146. Ridges 146 may be used to align weights 170 in space 144, and may be used to prevent rotation of weight 170 within space 144.

Shell assembly 140 further includes shaft 150. Shaft 150 extends within the interior space 144 of shell 142. Shaft 150 may be coupled for rotation relative to the other components of shell assembly, such as shell 142. As will be described in greater detail below, rotation of shaft 150 when weights 170 are received within interior space 144 may couple shaft 150 with one or more of weight 170.

Shaft 150 is configured to be coupled to driver 120 when shell assembly 140 is supported on base assembly 110. Shaft 150 is also configured to be decoupled from driver 120 when shell assembly 140 is removed from base assembly 110, e.g., when a user lifts shell assembly 140 off of base assembly 110 during a weight training exercise. Shaft 150 includes projections 152 for engaging with corresponding structures on weights 170, as described in greater detail below.

Figure 2B:
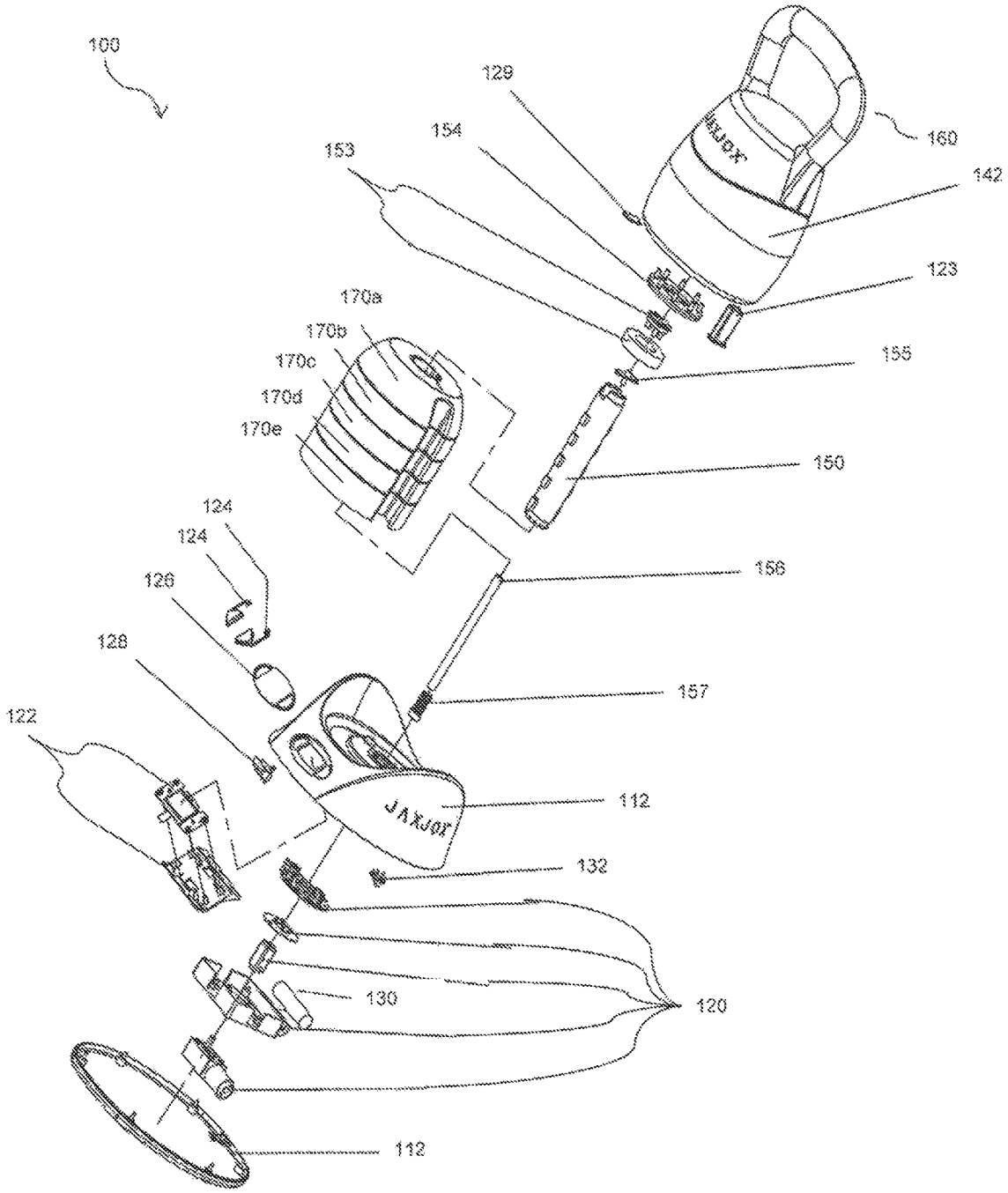
Figure 3A:
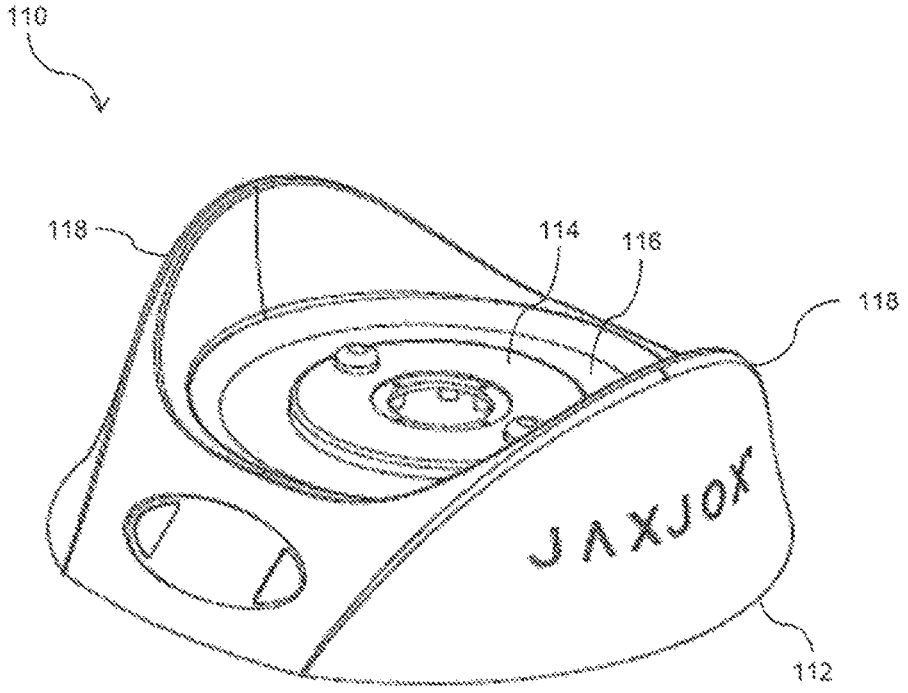
FIGS. 3A and 3B depict an exemplary base assembly of the exercise device of FIGS. 1A-1C.
Figure 3B:
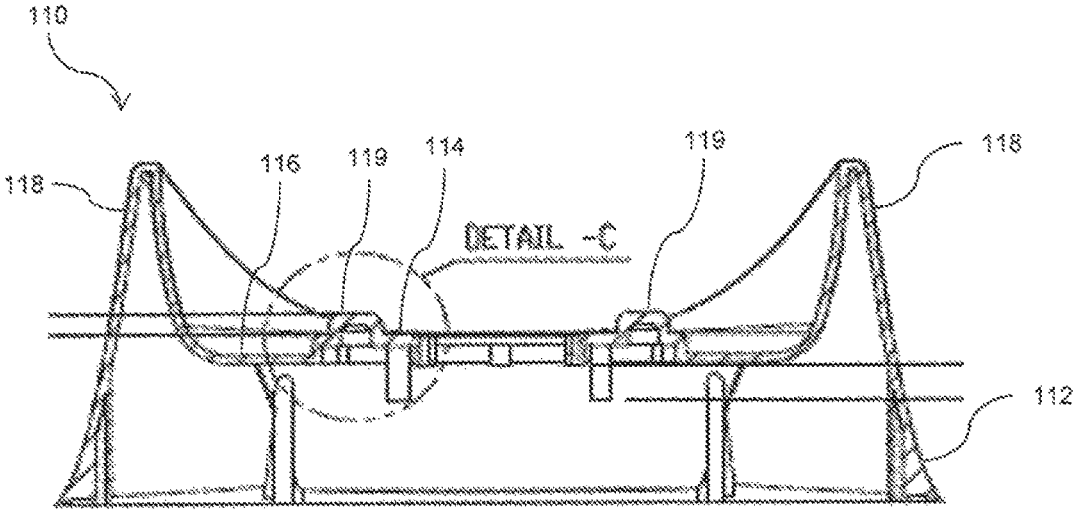
Figure 4A:
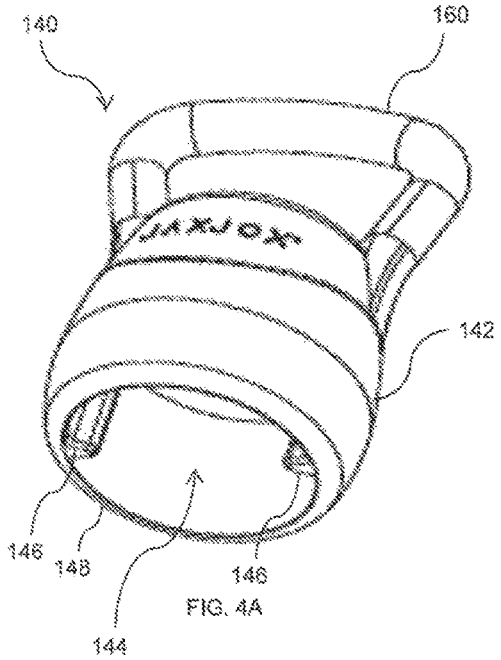
FIGS. 4A-4C depict an exemplary shell of the exercise device of FIGS. 1A-1C.
Figure 4B:
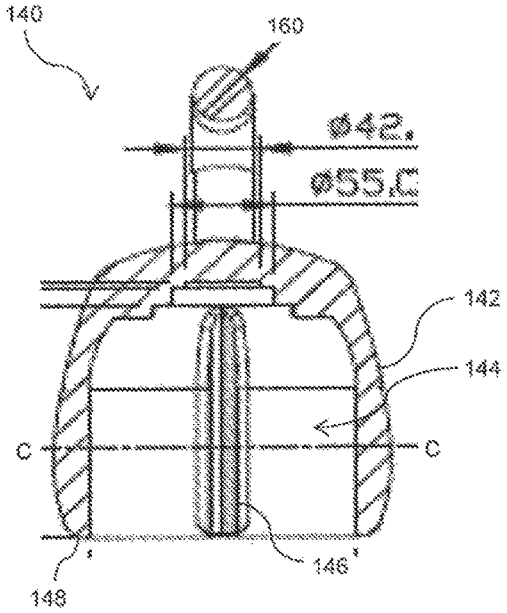
Figure 4C:
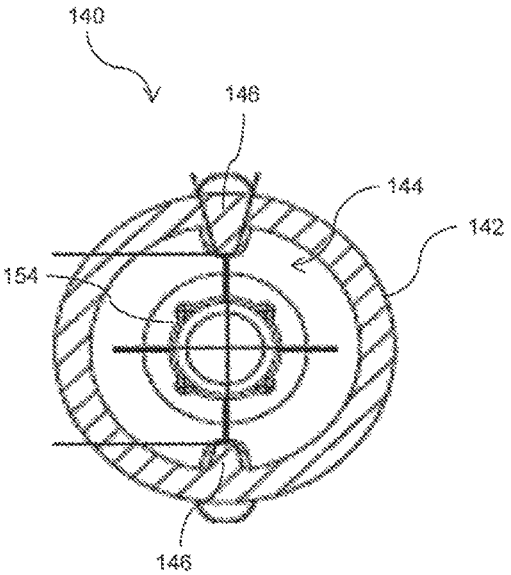
Figure 5A:
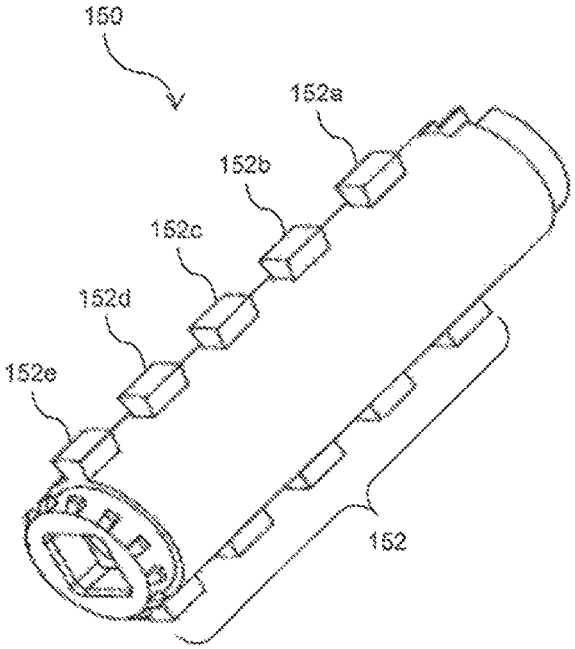
FIGS. 5A and 5B depict an exemplary shaft of the exercise device of FIGS. 1A-1C.
Figure 5B:
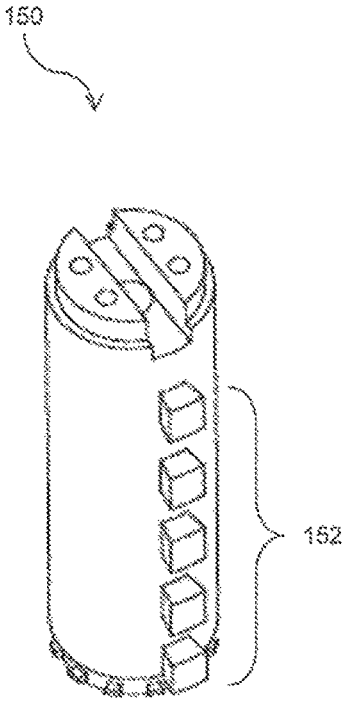

At the upper end of shaft 150, shell assembly 140 may further include one or more bearings 153 to enable rotation of shaft 150 relative to shell 142. Bearings 153 are coupled to shell assembly 150 by an upper fixed plate 154, and are coupled to shaft 150 by a fixed positional plate, as shown in FIG. 2B. At the lower end of shaft 150, shaft 150 is configured to be coupled to driver 120 by way of a linkage including a connecting rod 156 and a fixed block 157 having a spring, as shown in FIG. 2B.

Shell assembly 140 may further comprise a handle 160 positioned to be grasped by the user during the weight training exercise. As shown in FIGS. 2A, 2B, and 4A-4C, handle 160 is coupled to the exterior of shell 142. Handle 160 is provided at the apex of shell assembly 140, at a location of shell 142 opposite the coupling of shaft 150 to shell 142. Handle 160 is oriented orthogonally relative to shaft 150. However, it will be understood that, based on the type of weight training which is desired to be performed with exercise device 100, handle 160 may have a different orientation or an adjustable orientation, e.g. a parallel or oblique orientation, relative to shaft 150.

Weights 170 are selectively coupled to shell assembly 140 to enable performance of adjustable weight training exercises. As shown in FIGS. 2A and 2B, weights 170 are configured to be positioned adjacent one another, e.g., in a stacked orientation. In this orientation, all weights 170 are capable of fitting in the interior space 144 of shell 142. Thus, shell 142 is capable of being positioned overtop weights 170, and a lower edge 148 of shell 142 may rest on a surface 116 of base assembly 110.

As shown in FIGS. 6A-10B, device 100 may include five weight 170*a*, 170*b*, 170*c*, 170*d*, and 170*e*. It will be understood, however, that the number of weights shown in the drawings is provided for the purpose of illustration, and is not intended to be limiting. Any number of weights may be provided based on the desired amount, degree, or level of adjustability of exercise device 100. For a non-limiting example, 2, 3, 4, 5, 6, 7, 8 or more weights 170 may be provided in device 100, and weights 170 may be provided in increments of 1, 2, 3, 4, 5, 10, or 20 pounds.

Each weight 170 has a respective opening 172. Where weights 170 have a circular cross-section, opening 172 may be provided at a center or central region of each weight. When weights 170 are positioned in a stacked orientation, openings 172 are aligned or overlap with one another, such that openings 172 define an aperture extending along an axis of the stacked weight 170 from the uppermost weight 170*a* to the lowermost weight 170*e*.

Figure 6A:
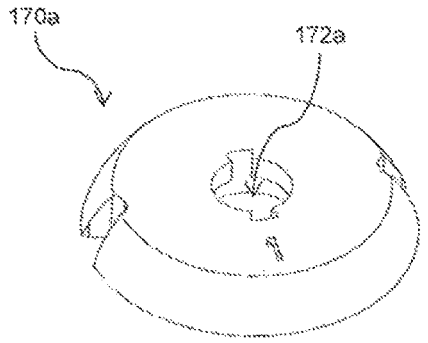
FIGS. 6A, 6B, 7A, 7B, 8A, 8B, 9A, 9B, 10A, and 10B depict exemplary weights of the exercise device of FIGS. 1A-1C.
Figure 6B:
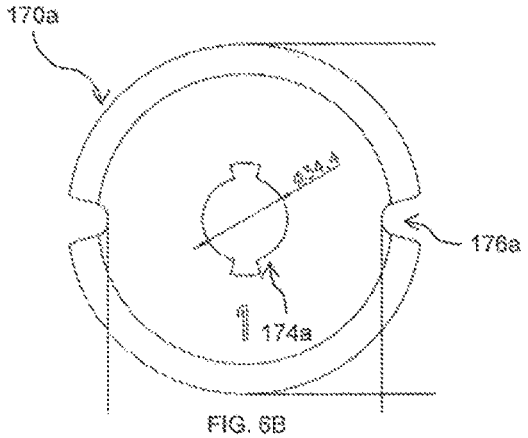
Figure 7A:
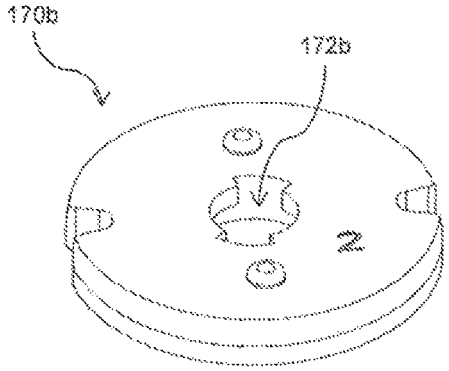
Figure 7B:
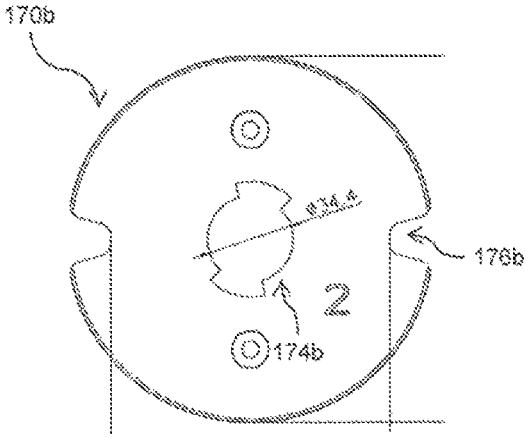
Figure 8A:
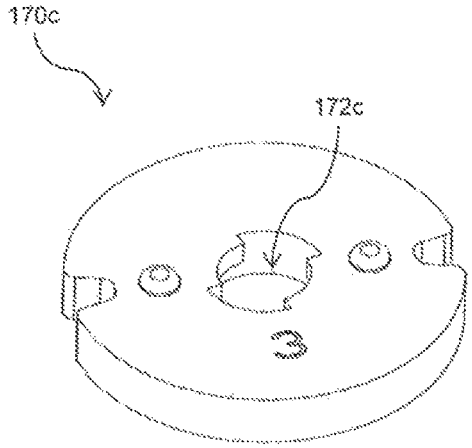
Figure 8B:
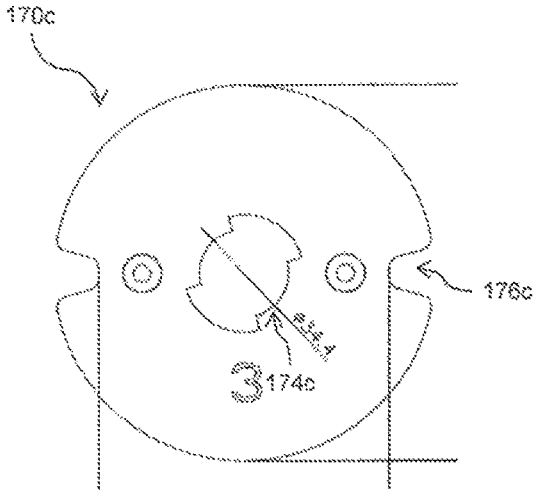
Figure 9A:
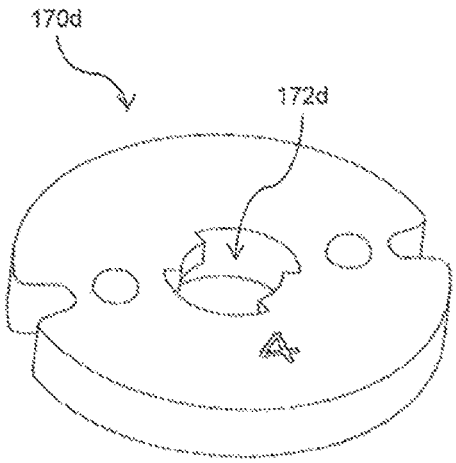
Figure 9B:
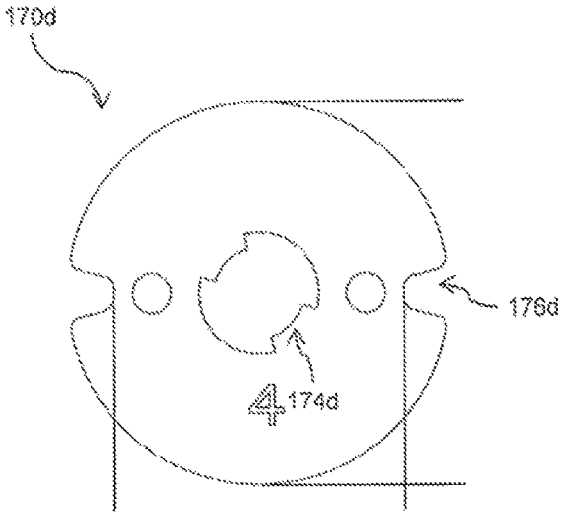
Figure 10A:
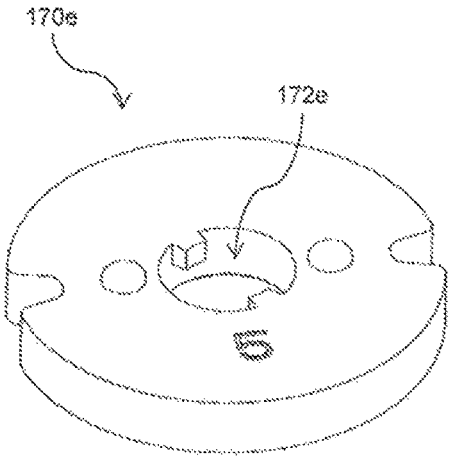
Figure 10B:
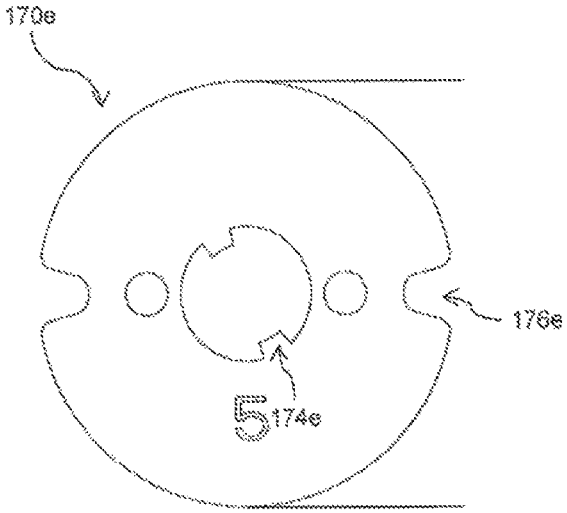

Each weight 170 has one or more ledges 174 extending into its respective opening. The circumferential width of a particular ledge 174 is dependent on where the respective weight is positioned in the stack of weights 170; the higher the weight 170 in the stack, the wider the ledge 174. As shown in FIG. 6A, ledge 174*a* has the largest width (covering nearly half of opening 172*a*), and ledge 174*e* has the smallest width (covering very little of opening 172*e*).

Each weight 170 may have one or more slots 176 on a periphery thereof. When weights 170 are positioned in a stacked orientation, slots 176 are aligned or overlap with one another, such that they may together slide along ridges 146 on the interior of shell 142.

An exemplary operation of exercise device 100 is described below in accordance with aspects of the present invention and with general reference to the embodiments of exercise device 100 illustrated in the figures.

Before the weight training exercise, weights 170 are provided in a stacked orientation on surface 114 of base assembly 110. In this position, the aperture defined by openings 172 extends from the upper surface of the uppermost weight 170*a* down through the remaining weight 170 to the region of driver 120.

Prior to performing a weight training exercise, the user places shell assembly 140 overtop the stacked weights 170. Alternatively, shell assembly 140 may already be positioned overtop weight 170, with the lower surface 148 of shell 142 supported on surface 116 of base assembly 110. In this position, shaft 150 extends through the aperture formed by openings 172, and can physically couple with driver 120.

When the user is ready to begin the exercise, the user may provide the appropriate input via input device 124. The input may comprise a selection of a type of weight training exercise, an amount of weight, or a number of weights 170. Responsive to receiving this input, driver 120 automatically moves shaft 150 to engage with a number of weights 170 corresponding to the user's input. Where base assembly 110 includes a controller 122, controller 122 controls driver 120 to rotate shaft to selectively couple shaft 150 with the appropriate number of weights 170. Controller 122 may be programmed to determine, or may have predetermined, the appropriate number of weights 170 corresponding to the user input, e.g. the type of weight training exercise or the amount of weight selected by the user. Where the user selects a number of weights, controller 122 may control driver 120 to rotate shaft 150 to couple with the selected number of weights 170.

Alternatively or in addition to input device 124, driver 120 may operate in response to the receipt of a communication by communication device 128. The user of exercise device 100 may wirelessly transmit a selection of a type of weight training exercise, an amount of weight, or a number of weights 170 to communication device 128 device 100, e.g., using the user's smartphone. Upon receipt of this data, controller 122 electrically controls driver 120 to rotate shaft 150 based on the data received from communication device 128.

Rotation of shaft 150 by driver 120 causes one or more of the projections 152 to selectively engage with corresponding ledges 174 on weight 170. The number of ledges 174 which are engaged by projection 152 is dependent on the rotational position of shaft 150. As such, driver 120 may control the number of weights 170 which are engaged with shaft 150 by controlling the rotational position of shaft 150. An example of such positioning is described below.

In a first rotational position of shaft 150, none of projections 152 underlie any of ledges 174. In this position, shaft 150 is freely movable through openings 172, e.g., to allow lifting of shell assembly 140 without any associated weights 170.

In a second rotational position of shaft 150, an uppermost projection 152*a* underlies ledge 174*a* of weight 170*a*, while the remaining projections 152 do not underlie any other ledges 174. In this position, shaft 150 engages with weight 170*a*, i.e., prevents axial movement of weight 170*a* relative to shaft 150, to allow lifting shell assembly 140 with weight 170*a* associated therewith.

In a third rotational position of shaft 150, an uppermost projection 152*a* underlies ledge 174*a* of weight 170*a*, and a next projection 152*b* underlies ledge 174*b* of weight 170*b*, while the remaining projections 152 do not underlie any other ledges 174. In this position, shaft 150 engages with weights 170*a* and 170*b*, i.e., prevents axial movement of weights 170*a* and 170*b* relative to shaft 150, to allow lifting shell assembly 140 with weights 170*a* and 170*b* associated therewith.

It will be understood that shaft 150 may be rotated into fourth, fifth, and sixth rotational positions, etc., to add engagement with weights 170*c*, 170*d*, and 170*e* in a similar fashion to that described above. Likewise, it will be understood that shaft 150 may be rotated to any number of rotational positions depending on the total number of weights 170 which are available to be engaged with shaft 150. For example, when exercise device 100 includes three total weights, shaft 150 may be rotatable to four different positions, whereas when exercise device 100 includes seven total weight, shaft 150 may be rotatable to eight different positions.

When shaft 150 is rotated to the correct rotational position, and the appropriate number of weights 170 are engaged with shaft 150, shaft 150 may be decoupled from driver 120 by lifting shell assembly 140 off of base assembly 110, e.g., by a user grasping handle 160 and lifting shell assembly 140. The user of exercise device 100 may then perform a desired weight training exercise with exercise device 100. Advantageously, decoupling shaft 150 from driver 120 removes the means for rotating shaft 150, and thereby prevents rotation of shaft 150, thereby preventing decoupling of the weights 170 from shaft 150 during the weight training exercise.

Figure 11:
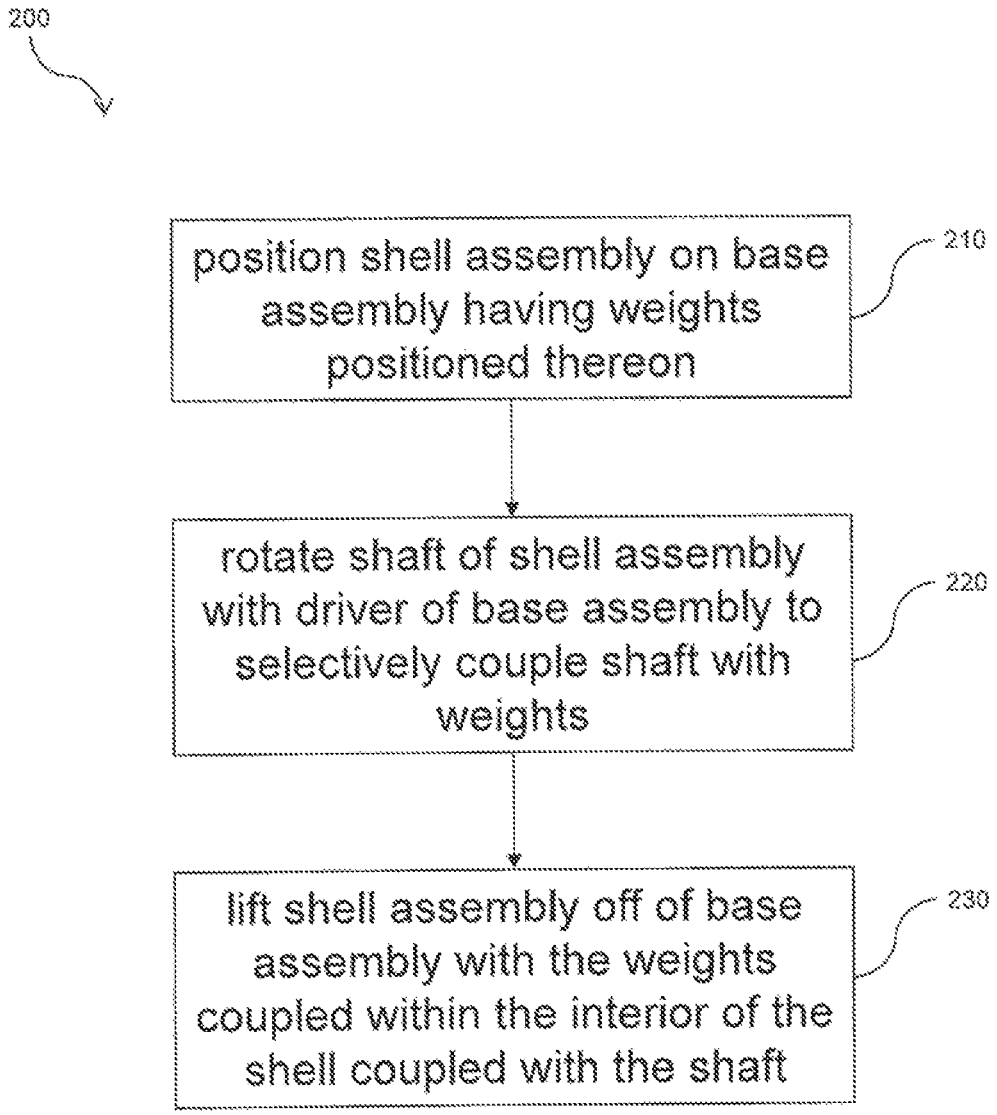
FIG. 11 depicts an exemplary exercise method in accordance with aspects of the present invention.

FIG. 11 illustrates an exemplary exercise method 200 in accordance with aspects of the present invention. As a general overview, method 200 includes positioning a shell assembly, rotating a shaft to selectively couple the shaft with one or more weight, and lifting the shell assembly. Additional details of method 200 are described below with respect to the component of device 100.

In step 210, a shell assembly is positioned on a base assembly having a plurality of weights positioned thereon. In an exemplary embodiment, shell assembly 140 is positioned on surface 116 of base assembly 110 overtop weights 170, such that weights 170 are received within interior space 144 of shell 142 of shell assembly 140. When shell assembly 140 is positioned overtop weights 170, shaft 150 is positioned within the defined by opening 172 in weights 170.

In step 220, a shaft of the shell assembly is rotated to selectively couple the shaft with one or more of the plurality of weights. In an exemplary embodiment, shaft 150 is rotated relative to shell 142 and weights 170. Shaft 150 is rotated by driver 120 of base assembly 110. Driver 120 rotates shaft 150 based on input provided by the individual performing the exercise to the input device 124, which is then communicated to controller 122. Rotation of shaft 150 by driver 120 causes shaft 150 to selectively engage with a desired number of weights 170, e.g., a number selected by an individual performing exercise method 200. In a further embodiment, this engagement include rotating shaft 150 to cause projections 152 on shaft 150 to engage with (e.g., underlie) respective ledges 174 of the desired number of weights 170, to prevent movement of the desired number of weights 170 along the axis of shaft 150.

In step 230, the shell assembly is lifted. In an exemplary embodiment, shell assembly 140 is lifted off of base assembly 110 by the individual performing exercise method 200. The individual may lift shell assembly 140 my grasping handle 160 of shell assembly 140. Shell assembly 140 is lifted with the weights 170 which are coupled with shaft 150 being held in the interior space 144 of shell 142. Engagement between projections 152 on shaft 150 and ledges 174 on weight 170 prevents decoupling of the weight 170 from shaft 150 when shell assembly 140 is lifted off of base assembly 110.

Figure 12:
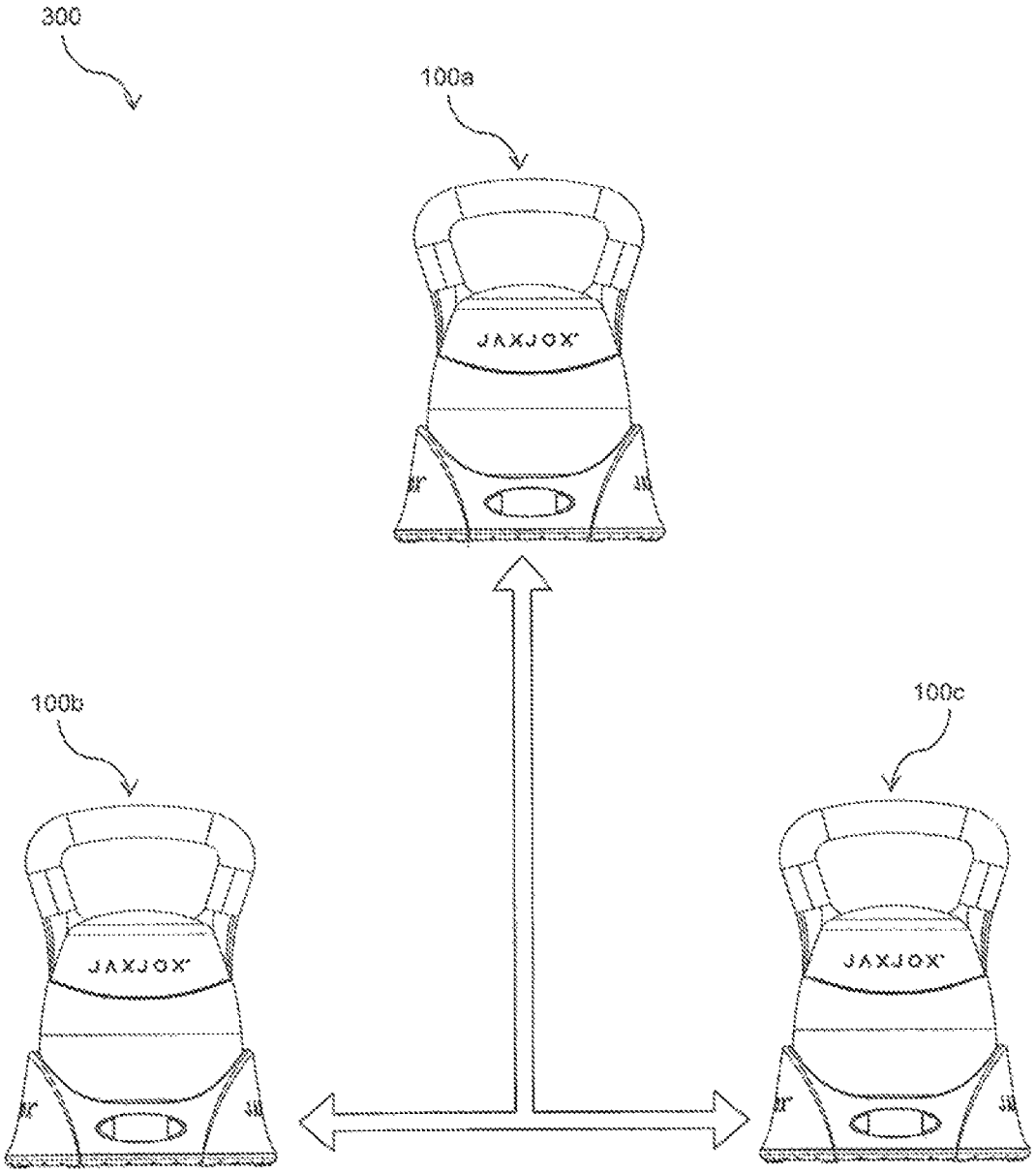
FIG. 12 depicts an exemplary exercise system in accordance with aspects of the present invention.

FIG. 12 illustrates an exemplary exercise system 300 in accordance with aspects of the present invention. As a general overview, system 300 includes a plurality of exercise devices 100. Additional details of system 300 are described below with reference to the components of exercise device 100.

As set forth above, exercise device 100 comprises a base assembly 110. In system 300, each exercise device 100 may comprise a respective base assembly 110. Alternatively, system 300 may comprise one or more combined base assemblies configured to support multiple shell assemblies and weight stacks. Such a combined base assembly may comprise subcomponents (e.g., input devices, displays, and communication devices) for each shell assembly supported by the combined base assembly, or may include a single subcomponent which is associated with each of the shell assemblies and weight stacks supported by the combined base assembly.

The driver 120 of each base assembly 110 of the exercise devices 100 (or the driver 120 of the combined base assembly) are configured to rotate respective shafts 150 based on data received via the associated communication device 128. In an exemplary embodiment, one of the exercise devices 100*a* (e.g., a master exercise device) receives an input from a user (e.g., via an input device 124) comprising a selection of a number of weight 170. The communication device 128 associated with the master exercise device 100*a* then transmits the input from the user to the communication device(s) 128 of one or more of the other exercise devices 100*b*, 100*c* in system 300 (as indicated by arrow in FIG. 12). These other exercise devices 100*b* and 100*c* are configured to receive data from the communication device 128 of the master exercise device 100*a*, and operate driver 120 to rotate shaft 150 to engage the appropriate number of weights 170. In this manner, one user of exercise system 300 (e.g., a weight trainer) may control the weight selection for each of the other users of exercise system (e.g., students).

Figure 13:
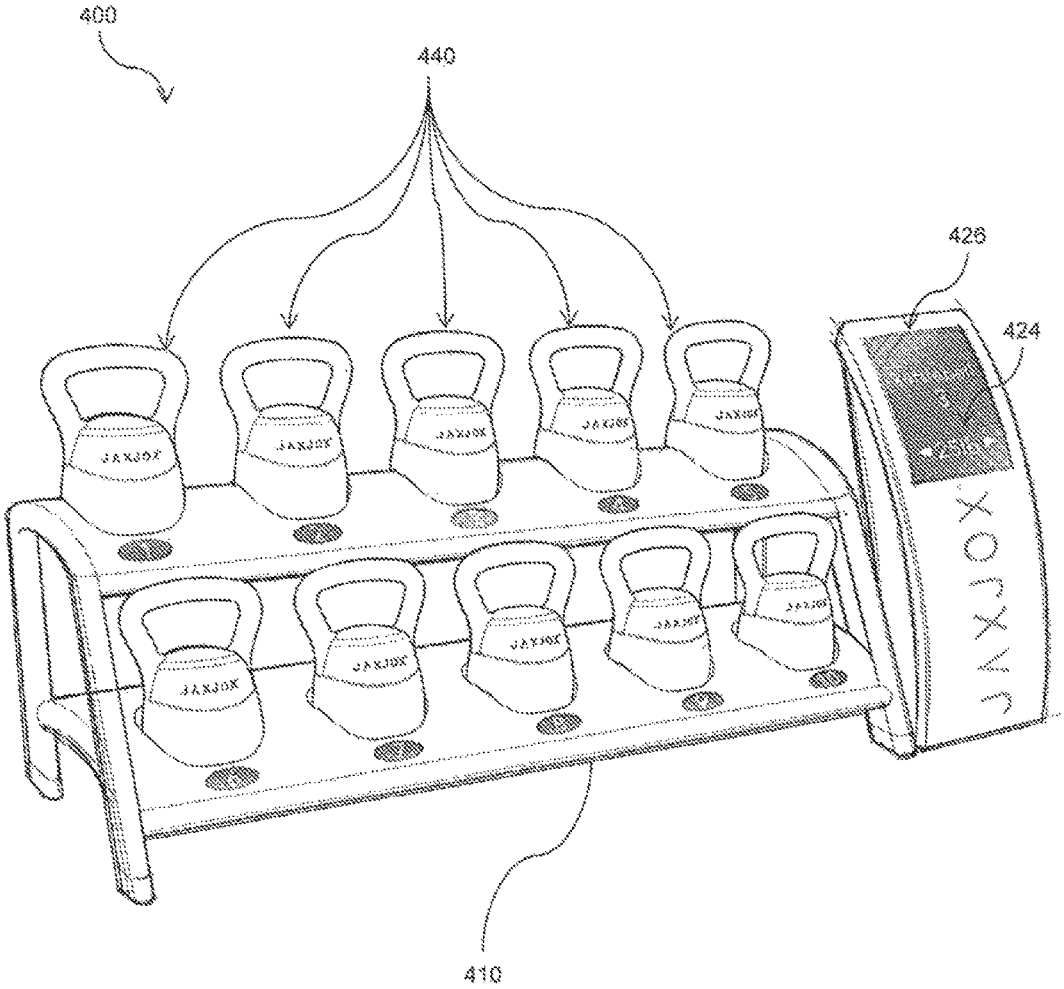
FIG. 13 depicts another exemplary exercise system in accordance with aspects of the present invention.

FIG. 13 illustrates another exemplary exercise system, exercise system 400, in accordance with aspects of the present invention. Generally, this invention also provides an exercise system comprising a plurality of exercise devices each having a plurality of weights configured to be positioned adjacent one another, each of the exercise devices being configured to engage a selected number of the plurality of weights. The exercise system also comprises at least one base assembly having a base configured to support the plurality of weights of at least one of the exercise devices, the base assembly being configured to be coupled to and decoupled from at least one of the exercise devices. The exercise system optionally includes an interface configured to communicate with one or more of the plurality of exercise devices. The base assembly is optionally configured to cooperate with one or more of the exercise devices, such as to increase or decrease the number of the weights engaged by one or more of the exercise devices, based on information received from or communicated to the interface.

As a general overview, system 400 includes a base assembly 410 and a plurality of shell assemblies 440. Base assembly 410 and shell assemblies 440 may include any of the components described above with respect to exercise device 100. Additional details of system 400 are described below.

Base assembly 410 provides support for the components of system 400, including each of the shell assemblies 440. Base assembly 410 is a combined base assembly, which may comprise subcomponents (e.g., drivers, input devices, controllers, communication devices, etc.) associated with each shell assembly 440 or groups of shell assemblies 440 supported by the combined base assembly, or may include a single subcomponent which is associated with each or all of the shell assemblies 440 and weight stacks supported by the combined base assembly 410.

Base assembly 410 houses a driver for each of the shell assemblies 440 supported on base assembly 410. Each driver is configured to be coupled to and decoupled from a respective shaft of each shell assembly 440, as described above with respect to exercise device 100.

Base assembly 410 may further comprise one or more controllers. Base assembly 410 may comprise a plurality of controllers, e.g., one controller for each driver or for each group of drivers, or may comprise a single master controller which electrically controls all drivers.

System 400 may further comprise a user interface such as an input device 424. Input device 424 receives input from a user of exercise system 400. Input device 424 may be operable to select a number of weights for any of the shell assemblies 440 of system 400, as described above with respect to exercise device 100. Input device 424 may enable the same weight to be input for all shell assemblies 440, or may allow the weight of each shell assembly 440 to be individually set.

The form of input device 424 is not intended to be limited. As shown in FIG. 13, input device 424 may be formed separately from base assembly 410, and communicate with the controller(s) in base assembly 410 by wire or wirelessly. Alternatively, input device 424 may be integrated into one structure with base assembly 410. A single input device 424 may be provided for all shell assemblies 440, or an input device 424 may be provided for each shell assembly 440. Structures for use as input device 424 will be known from the description herein.

As shown in FIG. 13, input device 424 may be integrated with a display 426. Display 426 is configured to display the input provided by the user to input device 424, e.g., the selected exercise, amount of weight, or a selected number of weights. As with input device 424, a single display 426 may be provided for all shell assemblies 440, or a display 426 may be provided for each shell assembly 440 or groups or subgroups of shell assemblies 440. Suitable displays for use as display 426 will be known from the description herein.

Shell assemblies 440 are grasped and lifted by users of system 400. Each shell assembly 440 includes a shaft which may be selectively coupled with one or more weights housed in the interior of respective shell assemblies 440, as described above with respect to exercise device 100.

Accordingly, a multi-stand embodiment such as the exercise system illustrated in FIG. 13 has the ability to display multiple exercise devices, such as kettlebells for example, on one stand and will either have one main display that controls all of the exercise devices or multiple displays with each display controlling an adjacent exercise device. The weight of each exercise device can either be the same or different weight per each device. For example, and for purposes of illustration, the top half of the exercise devices (on the top rack illustrated in FIG. 13) could each hold a maximum of 42 lbs, and the bottom half could have a maximum weight of 90 lbs. Other weights and combinations of weight variations are also contemplated.

The exercise devices and systems according to this invention are optionally provided with a wide range of ornamental shapes and designs and contours, depending on factors such as consumer preferences, aesthetic considerations, source identification, etc. Various ornamental designs can therefore be selected independent of the functionality described herein. For example, and for purposes of illustration, exemplary ornamental features of the exercise device are shown in co-pending U.S. patent application Ser. No. 29/635,801, filed Feb. 2, 2018, the disclosure of which is incorporated herein by reference.

FIGS. 14A-14G, 15 and 18A-18F illustrate an exemplary exercise device or apparatus 500 in accordance with aspects of the present invention. Exercise device 500 may be, for example, provided in the form of a dumbbell. Exercise device 500 may alternatively be a barbell.

As a general overview, device 500 includes a base assembly 510, a shell assembly 540, and a plurality of weights 570. Additional details of device 500 are described below.

Referring generally to FIGS. 14A-14G and 15, an exercise device 500 includes a plurality of weights 570 configured to be positioned adjacent one another; a shell assembly 540 having a shell including a handle shaft 542 defining an interior, the shell assembly 540 also having a shaft 544 coupled for movement relative to the shell and extending within the interior of the shell, wherein movement of the shaft 544 relative to the shell selectively couples the shaft 544 with one or more of the plurality of weights 570; and a base assembly 510 having a base including a housing 512 configured to support the plurality of weights 570 and the shell assembly 540, the base assembly 510 also having a driver including a motor 523 configured to be coupled to the shaft 544 of the shell assembly 540 when the shell assembly 540 is supported by the base including a housing 512, the driver 523 also being configured to be decoupled from the shaft 544 of the shell assembly 540 when the shell assembly 540 is not supported by the base including a housing 512; wherein the driver 523 of the base assembly 510 is configured to move the shaft 544 of the shell assembly 540 relative to the shell of the shell assembly 540 when the driver 523 is coupled to the shaft 544 of the shell assembly 540 to selectively couple the shaft 544 with the one or more of the plurality of weights 570.

The plurality of weights 570 are arranged in plural groups, each of the plural groups positioned on opposite sides of the shell assembly, and wherein the shell assembly 540 has plural shafts 544, each of the plural shafts being coupled for movement relative to the shell and extending within the interior of the shell, wherein movement of the shafts 544 relative to the shell selectively couples the shafts 544 with one or more weights 570 in each of the groups of weights 570.

Each of the plurality of weights 570 has an opening 582, the openings 582 of the plurality of weights 570 at least in part defining an aperture 582' extending along an axis 'B' when the plurality of weights 570 are adjacent one another.

The shaft 544 of the shell assembly 540 is positionable within the aperture 582' defined by the plurality of weights. Each of the plurality of weights 582 includes one or more engagement surfaces 580/590. Movement of the shaft 544 relative to the shell by the driver 523 causes the shaft 544 to selectively engage with one or more of the plurality of weights 570 to limit or prevent movement of the one or more of the plurality of weights 570 along a direction orthogonal to the axis B of the aperture 582.

The shell assembly 540 further comprises a handle portion 542 positioned to be grasped by a user of the exercise device 500. The driver 523 comprises a motor 523, and the base assembly 510 further comprises a controller that electrically controls the motor 523 to move the shaft 544 based on an input from a user of the exercise device.

The base assembly 510 further comprises an input device 521 which is electrically or mechanically coupled to the driver 523 to cause the driver to rotate the shaft 544 based on input from a user of the exercise device 500.

Decoupling of the shaft 544 of the shell assembly 540 from the driver 523 of the base assembly prevents movement of the shaft 544 relative to the shell, thereby preventing decoupling of the one or more of the plurality of weights 570 from the shaft 544 of the exercise device 500.

An exercise method is also provided, including positioning a shell assembly 540 on a base assembly 510 having a plurality of weights 570 positioned thereon; moving a shaft 544 of the shell assembly 540 relative to the shell with a driver 523 of the base assembly 510 coupled to the shaft 544 to selectively couple the shaft 544 with one or more of the plurality of weights 570; and lifting the shell assembly 540 off of the base assembly 510 with the one or more of the plurality of weights 570 coupled with the shaft 544 of the shell assembly 510.

Each of the plurality of weights 570 has an opening 582, the openings 582 of the plurality of weights 570 at least in part defining an aperture 582' extending along an axis B, and wherein the positioning step comprises positioning the shaft 544 of the shell assembly 540 within the aperture 582' defined by the plurality of weights 570. Each of the plurality of weights 570 includes one or more engagement surfaces 580/590, and wherein the moving step comprises moving the shaft 544 relative to the shell to cause the shaft 544 to selectively engage with the engagement surface 580/590 of respective ones of the plurality of weights 570 to prevent movement of the one or more of the plurality of weights 570 in a direction orthogonal to the axis B of the aperture 582'. The shell assembly 540 further comprises a handle portion 542, and wherein the lifting step comprises grasping the handle portion of the shell assembly 540. The driver 523 comprises a motor 523, and the base assembly 510 further comprises a controller that electrically controls the motor 523, and wherein the moving step comprises providing input to the controller to control the motor 523 to move the shaft 544. The base assembly 510 further comprises an input device 521 which is electrically or mechanically coupled to the driver 523, and wherein the moving step comprises receiving input with the input device 521 and causing the driver 523 to move the shaft 544 based on the received input. The exercise method further comprises preventing decoupling of one or more of the plurality of weights 570 from the shaft 544 of the exercise device when the shell assembly 540 is lifted off of the base assembly 510.

An exercise system includes a plurality of exercise devices 500 each having a plurality of weights 570 configured to be positioned adjacent one another; a shaft 544 configured for movement relative to the plurality of weights 570, wherein movement of the shaft 544 relative to the plurality of weights 570 selectively couples the shaft 544 with one or more of the plurality of weights 570; a base assembly 510 having a base configured to support the plurality of weights 570 and a driver 523 configured to be coupled to and decoupled from the shaft 544; and a communication device configured to wirelessly communicate with the communication device of another one of the plurality of exercise devices 500, wherein the driver 523 of one of the plurality of exercise devices 500 is configured to move the shaft 544 of the one of the plurality of exercise devices 500 based on data received from the communication device of another one of the plurality of exercise devices 500.

The driver 523 comprises a motor 523, and each base assembly 510 further comprises a controller that electrically controls the motor 523 to move the shaft 544 based on data received from the communication device of the other one of the plurality of exercise devices 500. The driver 523 of the one of the plurality of exercise devices is further configured to move the shaft 544 of the one of the plurality of exercise devices 500 based on an input from a user of the exercise system, and is further configured to transmit the input from the user to the communication device of another one of the plurality of exercise devices 500. The communication device is configured to wirelessly communicate data corresponding to the number of weights 570 coupled to the shaft 544 of one of the plurality of exercise devices 500 to another one of the plurality of exercise devices 500.

An exercise device includes a plurality of weights 570 configured to be positioned adjacent one another; a shaft 544 configured to engage with one or more of the plurality of weights 570; a base assembly 510 having a driver 523 configured to be coupled to and decoupled from the shaft 544; and an input device 521 associated with the shaft 544 or the base assembly 510, the input device 521 being configured to receive an input from a user of the exercise device 500, the input comprising a selection corresponding to a number of the plurality of weights 570; wherein the driver 523 of the base assembly 510 is configured to automatically move the shaft 544 relative to the plurality of weights 570 when the driver 523 is coupled to the shaft 544 and when the input is received by the input device 521 to selectively engage the shaft 544 with the selected number of the plurality of weights 570.

The base assembly 510 further comprises a base configured to support the plurality of weights 570. Each of the plurality of weights 570 has an opening 582, the openings 582 of the plurality of weights 570 at least in part defining an aperture 582' extending along an axis B when the plurality of weights 570 are adjacent one another, the shaft 544 positionable within the aperture 582'. Each of the plurality of weights 570 includes one or more engagement surfaces 580/590. Movement of the shaft 544 by the driver 523 causes the shaft 544 to selectively engage with respective ones of the engagement surfaces 580/590 of the selected number of the plurality of weights 570 to prevent or limit movement of the one or more of the plurality of weights 570 in a direction orthogonal to the axis B of the aperture 582'. The shaft 544 is coupled to a handle portion oriented parallel relative to the shaft 544.

The driver 523 comprises a motor 523, and the base assembly 510 further comprises a controller that electrically controls the motor 523 to move the shaft 544 based on the input from the user of the exercise device 500. The exercise device 500 further comprises a display 519 configured to display a value corresponding to the selected number of the plurality of weights 570 or a weight corresponding to the selected number of the plurality of weights 570. A sensor 557/559 associated with the base or the shaft 544, the sensor 557/559 being configured to detect when the driver 523 is coupled to or decoupled from the shaft 544.

The handle portion 542 is provided along the shell of the shell assembly 540 and defines a handle axis B, each of the plurality of weights 570 extending radially outwardly from a weight axis B oriented parallel to the handle axis B.

The exercise device further comprising a drive shaft 527 coupled to the driver 523 and to the shaft 544 of the shell assembly 540 when the shell assembly 540 is supported by the base assembly 510, the drive shaft 527 being configured for rotation to move the shaft 544 relative to the shell of the shell assembly 540 when the drive shaft 527 is coupled to the shaft 544 of the shell assembly 540. The drive shaft 527 is positioned to extend into an interior of the shell assembly 540 when the driver 523 is coupled to the shaft 544 of the shell assembly 540 and the shell assembly 540 is supported by the base assembly 510. The drive shaft 527 is oriented orthogonally relative to a shaft axis B of the shaft 544 of the shell assembly 540.

The exercise device is selected from the group consisting of a dumbbell and a barbell. The plurality of weights 570 are arranged in plural groups, the groups being positioned on opposite sides of the shell assembly 540, and wherein the shell assembly 540 has plural shafts 544, each of the plural shafts 544 being coupled for movement relative to the shell and extending within the interior of the shell, wherein movement of the shafts 544 relative to the shell selectively couples the shafts 544 with one or more weights 570 in each of the groups of weights 570, and wherein movement of the shafts 544 relative to the shell selectively couples the shafts 544 with an equal number of weights 570 in each of the groups of weights 570.

The shell assembly 540 includes a handle shaft 542 and shell sub-assemblies 545, each coupled to an end portion of the handle shaft 542. Each of the shell sub-assemblies 545 at least partially defines an interior region. Drive shaft assemblies 531, each positioned at least partially within the interior region of the each of the shell sub-assemblies 545, each drive shaft assembly 531 positioned for engagement with a respective one of the shafts 544.

The exercise device further comprises plural drivers 523, each configured to be coupled to a respective one of the shafts 544 of the shell assembly 540 when the shell assembly 540 is supported by the base assembly 510, each of the drive shaft assemblies 531 being releasably couplable to a respective one of the drivers 523. Each of the shafts 544 having a gear rack 572, and the drive shaft surface of each of the drive shaft assemblies 531 including a gear 561 engaged with the gear rack 572 of a respective one of the shafts 544.

At least two weights 570 are configured to be placed adjacent one another along an axis B of the weights 570 to form a pair of weights, a first weight of the pair of weights including a male surface 580 and a second weight of the pair of weights including a female surface 590 configured to be engaged by the male surface 580 of the first weight, thereby limiting or eliminating movement of the first weight and the second weight of the pair of weights 570 relative to one another along the axis B. The first weight and the second weight of the pair of weights 570 each defines an aperture 582 extending along the axis B to receive the shaft 544 of the shell assembly 540 to selectively couple the shaft 544 with the first weight and the second weight, the shaft 544 limiting or eliminating movement of the first weight and the second weight of the pair of weights 570 relative to one another in a direction orthogonal to the axis B.

The shell assembly 540 including a memory configured to store data corresponding to movement of the shell assembly 540. The base assembly 510 including a memory configured to receive the data corresponding to movement of the shell assembly 540.

The base assembly 510 and the shell assembly 540 being configured to share the data corresponding to movement of the shell assembly 540 when the base assembly 510 is supporting the shell assembly 540. The base assembly 510 being configured to wirelessly transmit the data corresponding to movement of the shell assembly 540 to a remote device.

Referring now more specifically to details of the embodiment illustrated in FIGS. 14A-14G, 15 and 18A-18F, base assembly 510 provides support for the components of device 500. Base assembly 510 has a semi-cylindrical housing 512 and a base cover 513 that is removably mounted to the lower surface of the housing 512.

Figure 15A:
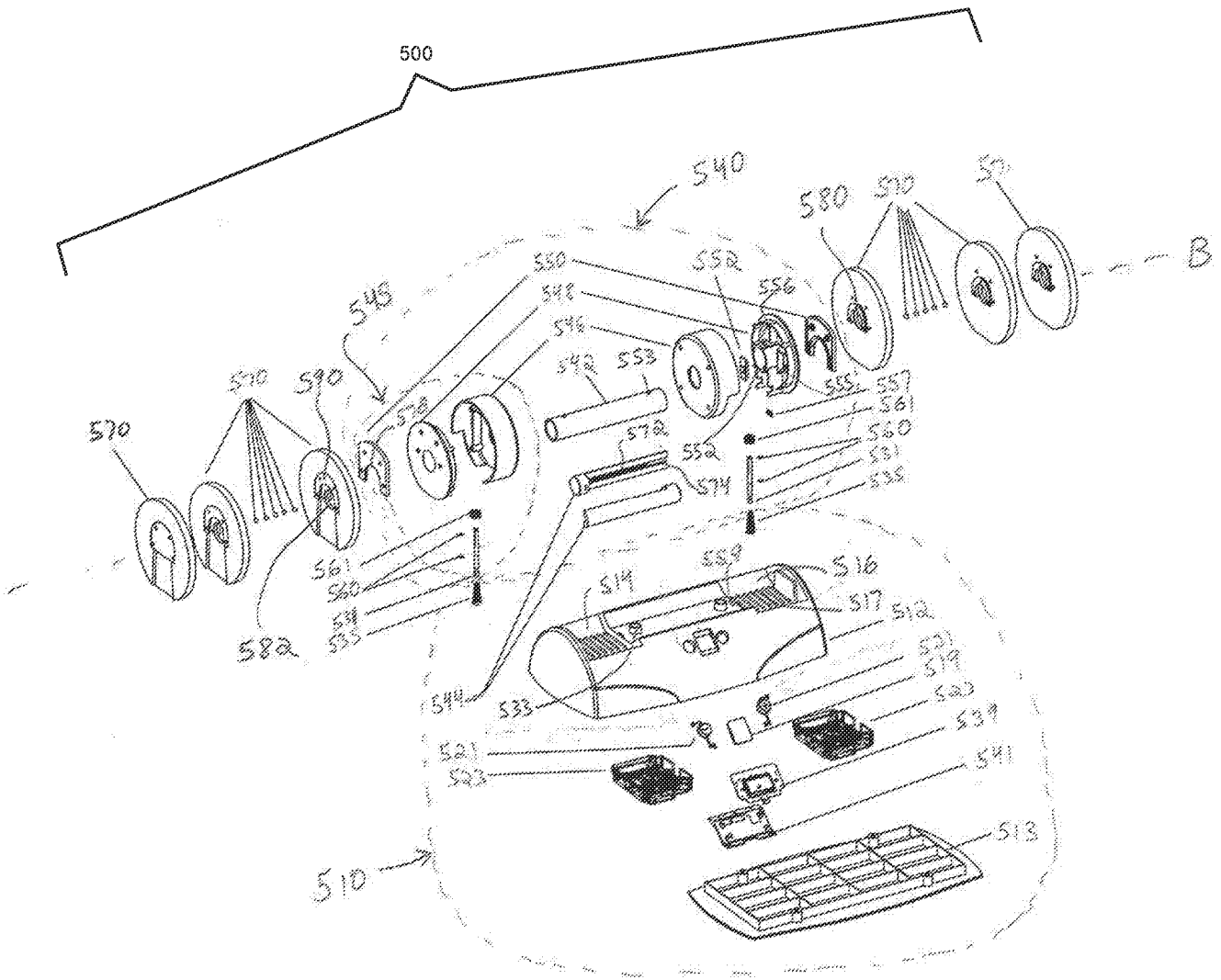
FIGS. 15A and 15B are exploded views of the device of FIGS. 14A-14G.
Figure 15B:
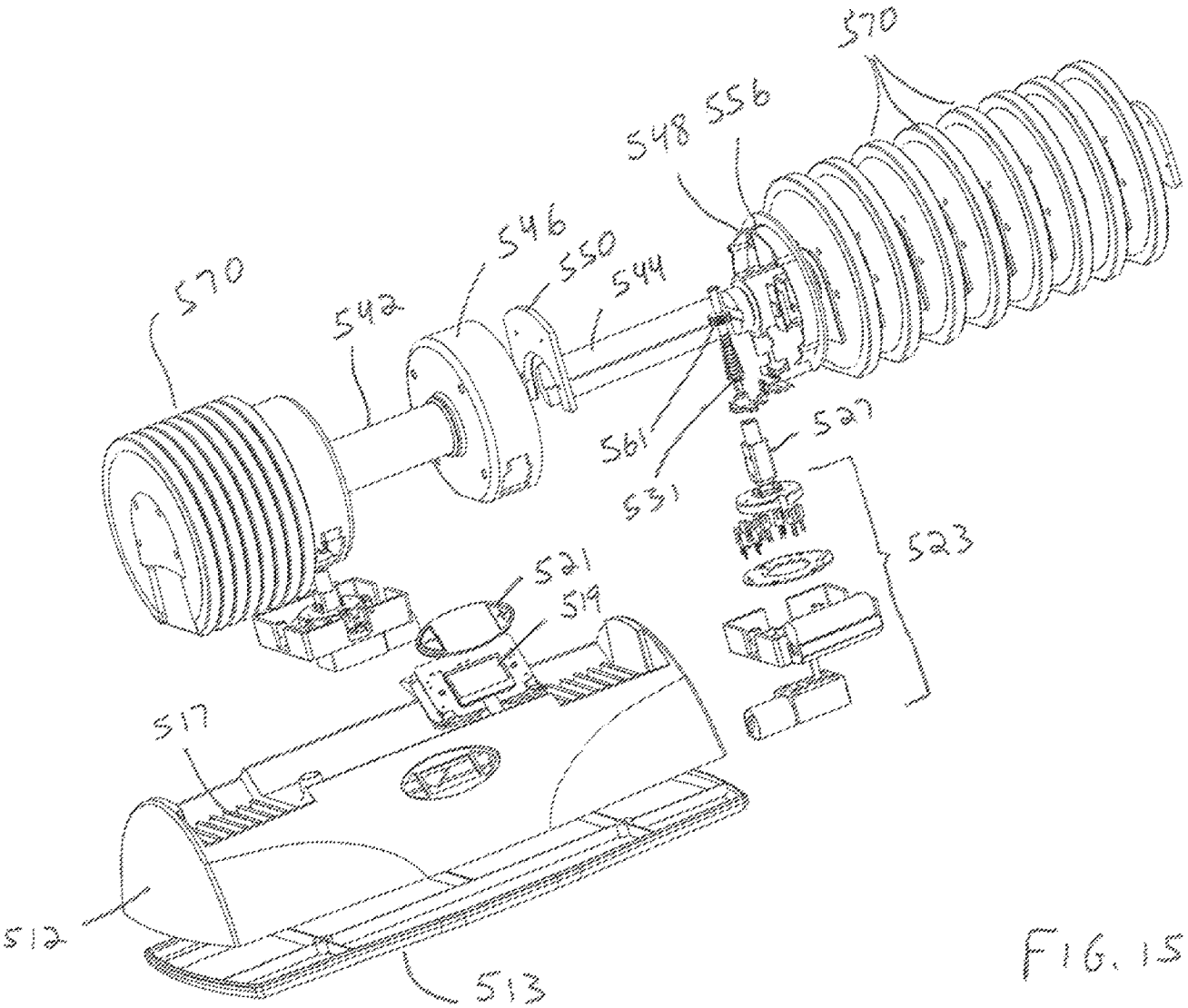

Housing 512 includes one or more exterior surfaces on which other components of device 500 may rest. As shown in FIG. 15, housing 512 of base assembly 510 includes a first surface 514 and a second surface 516 on an upper portion thereof. Surfaces 514 and 516 form a base configured to support shell assembly 540 and weights 570. Each surface 514, 516 includes upwardly protruding ribs 517 that are uniformly spaced apart and configured to support weights 570, e.g., in a stacked orientation. The lower surface of a weight 570 is sized to fit between two adjacent ribs 517.

Housing 512 includes a user control interface in the form of two user-operable buttons 521 for selecting a desired weight, and a display 519 disposed between buttons 521 for displaying the selected weight. One button 521 is labeled '+' for increasing the amount of weight (i.e., the number of weights 570) that is non-removably attached to shell assembly 540, and the other button 521 is labeled '–' for decreasing the amount of weight (i.e., the number of weights 570) that is non-removably attached to shell assembly 540. Buttons 521 may be generally referred to herein as a user input device.

Figures 14A, 14B, 14C, 14D, 14E, 14F, 14G:
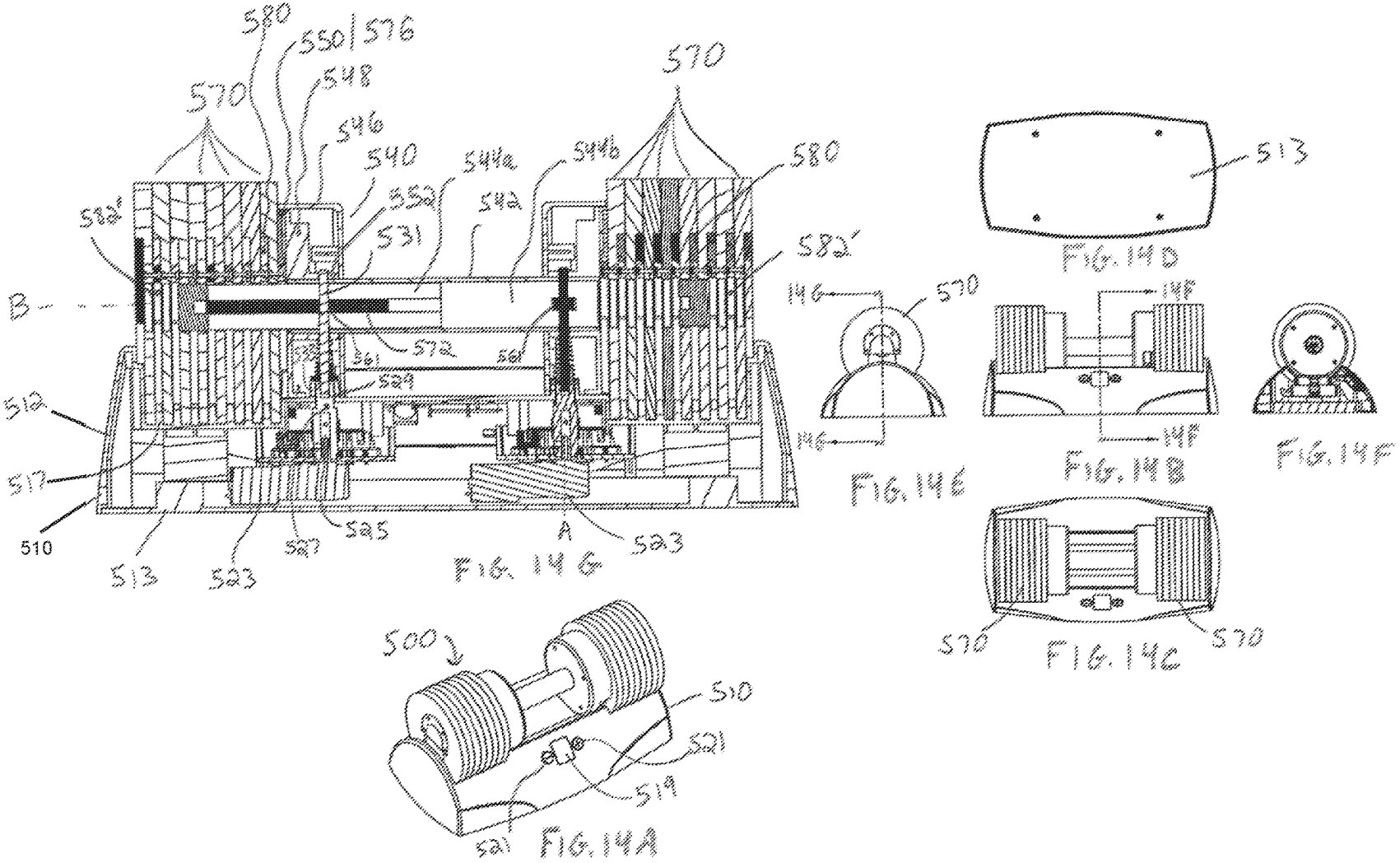
FIGS. 14A-14E depict isometric, front, top, bottom, and left side elevation views, respectively, of another exemplary exercise device in accordance with aspects of the present invention, wherein the telescopic shafts are shown in an extended position.
FIG. 14F depicts a cross-sectional side view of the device of FIG. 14B taken along the lines 14F-14F.
FIG. 14G depicts a cross-sectional side view of the device of FIG. 14E taken along the lines 14G-14G.

An interior region is defined within housing 512 which houses certain components of device 500. As best shown in FIG. 14G, according to this exemplary embodiment, a driver in the form of two motors 523 are mounted within the interior region. The driver is configured to adjust the amount of weight applied to shell assembly 540. Each motor 523 has an output shaft 525 that is configured to rotate about an axis. Those skilled in the art will recognize that driver may vary from that which is shown and described. For example, the driver could comprise a single motor 523.

Each output shaft 525 is non-rotatably connected to an intermediate shaft 527 such that the shafts 525 and 527 rotate together. The lower end of each intermediate shaft 527 is fixed to one of output shafts 525 such that shafts 525 and 527 rotate together, and the upper end of each intermediate shaft 527 includes an opening 529 that is configured to releasably receive a shaft 531 that forms part of shell assembly 540. Opening 529 of shaft 527 is keyed to the lower end of shaft 531 such that shafts 531 and 527 rotate together. It should be understood that shafts 531 and 527 are capable of being regularly detached and re-attached during operation of device 500.

The upper end of each intermediate shaft 527 is positioned within a hollow cylinder 533 (see FIG. 15) that protrudes from the top surface of housing 512, such that opening 529 in shaft 527 is visible and accessible from the exterior of housing 512. A spring 535 is positioned between the top end of shaft 527 and the interior surface of cylinder 533 to center shaft 527 within cylinder 533 and also ensure a positive connection between shafts 527 and 531. The top end of each intermediate shaft 527 may be flush with the top surface of cylinder 533. Alternatively, the top end of each intermediate shaft 527 may be either slightly depressed or protruding with respect to the top surface of cylinder 533.

A printed circuit board (PCB) 539 for interacting with display 519 and buttons 521 is mounted within housing 512. PCB 541, is also mounted within housing 512 for controlling motors. 523 based upon signals received from PCB 541, as will be described later. PCB 541 includes (at least) a processor, controller and a wireless transmitter/receiver for transmitting/receiving wireless signals, such as Bluetooth or Wi-Fi.

Referring now to shell assembly 540, shell assembly 540 is essentially a barbell without any weights 570 applied thereto. Shell assembly 540 generally includes a handle shaft 542 in the form of a hollow cylinder, a two-piece telescopic shaft 544 positioned within the hollow interior of handle shaft 542, and two shell sub-assemblies 545 mounted to opposing sides of shaft 542.

Shell sub-assemblies 545 are substantially identical and only one of the shell sub-assemblies 545 will be described hereinafter. Shell sub-assembly 545 generally includes a shell comprising a bowl-shaped cylindrical inner case 546, which is positioned closest to an end of shaft 542, an outer case 548 that is mounted to the open end of inner case 546, and a female dovetail connector 550 that is mounted to an exterior facing surface of outer case 548. A circular opening is formed through each shell sub-assembly and is substantially aligned with the longitudinal axis B.

As best shown in FIG. 14G, outer case 548 comprises a hollow cylinder 552 in which one end of the shaft 542 is received. Shaft 542 is fixedly and non-rotatably mounted to cylinder 552 by the shafts 531 that pass through holes 553 in shaft 542. Outer case 548 includes a series of snap connection features 555 that are releasably connected to mating features on inner case 546 for fastening the cases 546 and 548 together. Other means for mounting shaft 542, case 546 and case 548 are known to those skilled in the art.

A series of mechanical components are positioned within the hollow region defined between cases 546 and 548. More particularly, and referring still to only one of the substantially identical shell sub-assemblies 545, the shaft 531 is rotatably mounted within the hollow region. Shaft 531 registers with (i.e., passes through) opposing holes 553 in handle shaft 542 and opposing holes 556 in cylinder 552 of outer case 548. A c-clip 560 is mounted in a groove formed in shaft 531 at a location above cylinder 552, and another c-clip 560 is mounted in a groove formed in shaft 531 at a location below cylinder 552, thereby locking the axial position of shaft 531 with respect to handle shaft 542. It should be understood that shaft 531 is capable of rotating within holes 553 and 556, but does not translate relative to holes 553 and 556.

A toothed gear 561 is non-rotatably mounted to a central region of shaft 531 such that shaft 531 and gear 561 rotate together. Gear 561 and shaft 531 together form a drive shaft assembly. Gear 561 may be capable of translating to a slight degree along the length of shaft 531 (i.e., along axis A) to accommodate for misalignment between gear 561 and the toothed gear rack 572 on shaft 544 with which gear 561 is meshed.

Referring now to the features of telescopic shafts 544*a* and 544*b* (referred to collectively or individually as shaft(s) 544) of shell assembly 540, each telescopic shaft 544 has a substantially cylindrical shape having a cut-out region that defines a half-cylindrical section along a majority of the length of shaft 544. A rectangular channel 574 is formed along the length of the interior facing side (i.e., the side facing axis B) of the half-cylindrical section. Gear teeth forming a toothed gear rack 572 are defined along a substantial portion of the channel 574. In assembled form, the flat faces of the half-cylindrical sections are positioned to face each other. Each gear 561 is positioned within the channels 574 of both shafts 544, and the teeth of each gear 561 are meshed with both toothed gear racks 572, such that rotation of at least one of gears 561 about axis A causes translation of both shafts 544 along axis B. In normal operation, both gears 561 are rotated at the same time by motors 523 to cause translation of both shafts 544 along axis B. It should be understood that axes A and B are orthogonal. Due to the toothed engagement between the gears 561 and the toothed gear racks 572, the shafts 544 are configured to simultaneously translate in opposite directions. Shafts 544 are configured to move between a retracted position (see FIG. 18F) in which shafts 544 do not engage any weights 570, and a deployed position (see FIG. 14G) in which shafts 544 engage one or more weights 570.

Referring back to the features of the shell sub-assemblies 545, for one of the shell sub-assemblies 545, electronic components are also accommodated in the hollow region that is defined between cases 546 and 548. The electronic components include (i) a sensor 552 in the form of an accelerometer (for example) that senses motion of device 500, (ii) a rechargeable battery for powering sensor 552, and (iii) a PCB including memory and a processor for communicating readings of sensor 552 to base assembly 510 in a docked state of device 500. Spring pins 557 (also referred to as contacts) are connected to the PCB of shell sub-assembly 545 to transfer signals and power to and from PCB 541 of base assembly 510 in a docked state of shell assembly 540.

Female dovetail connector 550 of the shell sub-assembly 545 is mounted to an exterior facing surface of outer case 548, and is configured to be releasably mounted over a male dovetail connector 580 that is disposed on an adjacent weight 570. Female dovetail connector 550 may be mounted to case 548 by fasteners, for example, or, alternatively, female dovetail connector 550 may be formed with case 548 as a unitary member.

Female dovetail connector 550 includes a semi-circular female dovetail recess 576 having an open end on the lower surface. The open end is configured to slidably receive the male dovetail connector 580 on the adjacent weight 570. As will also be described with reference to FIG. 17, the dovetail joint formed between female connector 550 and male dovetail connector 580 of weight 570 prevents outer case 548 (along with the entire shell assembly 540) from rotating about axis B with respect to the attached weight 570. The dovetail joint also prevents the attached weight 570 from moving upward with respect to outer case 548 (and the entire shell assembly 540). The dovetail joint does not prevent the attached weight 570 from moving downward along axis A with respect to shell assembly 540—such downward translation is only prevented when one of the telescopic shafts 544 is positioned within an opening 582 formed in the attached weight 570. More particularly, when the telescopic shafts 544 is positioned within the opening 582 formed in the attached weight 570, the attached weight 570 is prevented from detaching from shell assembly 540 in the vertical direction due to the inter-engagement between the shaft 544, the central hole in the outer case 548, and opening 582 in the attached weight 570. The attached weight 570 is prevented from detaching from shell assembly 540 in the horizontal direction due to the inter-engagement between female dovetail connector 550 and male dovetail connector 580.

Referring now to the features of weights 570, the weights 570 are substantially identical and only one weight 570 will be described hereinafter with reference to FIGS. 16A-16G. Weight 570 is a circular plate having a first side 581, a second side 583 opposite first side 581, and a revolved surface 584 extending between and interconnecting the two sides 581 and 583. The base 584*a* of revolved surface 584 is flat for seating on a surface 514, 516 of housing 512. A circular opening 582 is formed in the center of weight 570 and is substantially aligned with the longitudinal axis B of weight 570.

Figure 17:
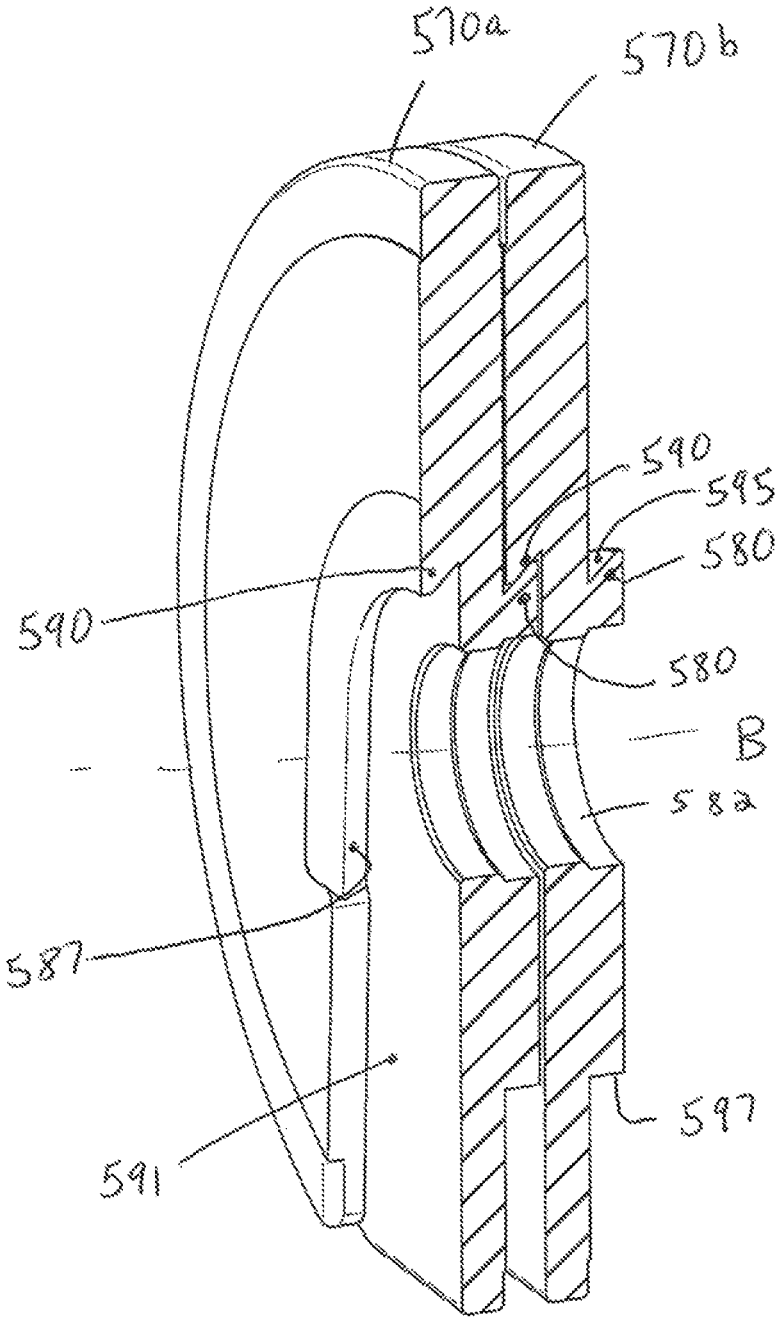
FIG. 17 depicts a cross-sectional side view of two weights mated together.
Figure 18A:
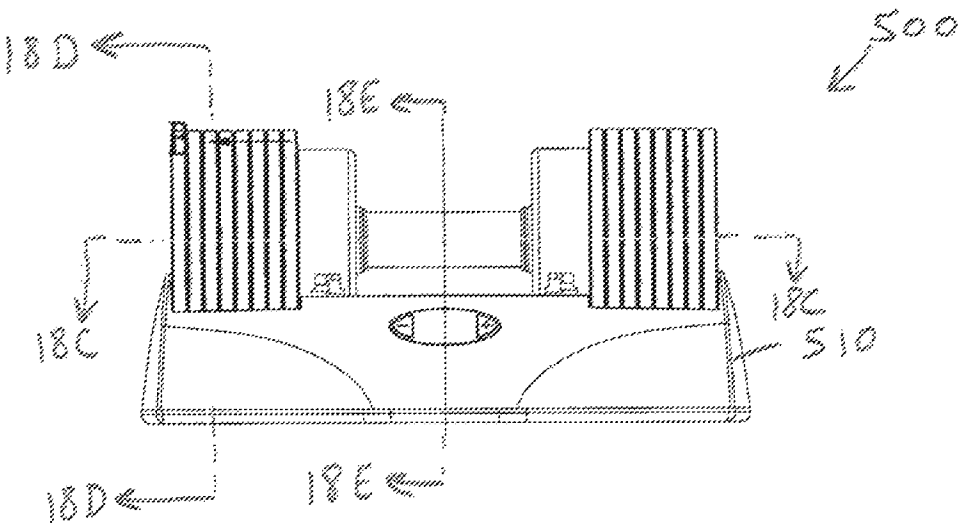
FIGS. 18A-18F depicts additional views of the exemplary exercise device of FIGS. 14A-14E, wherein the telescopic shafts are shown in a retracted position.
Figure 18B:
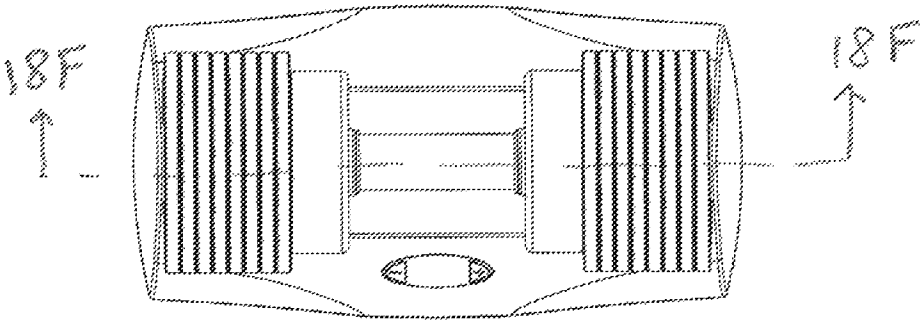
Figure 18C:
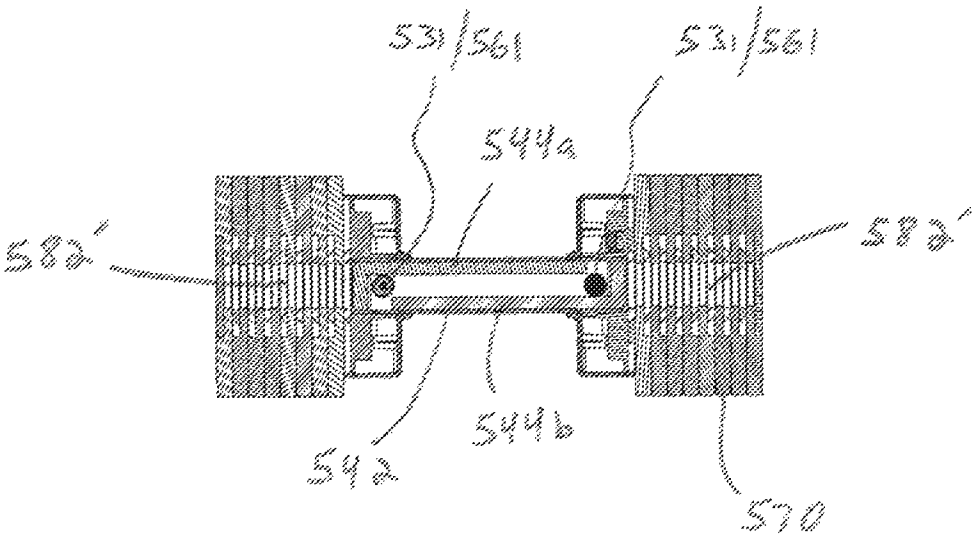
Figure 18D:
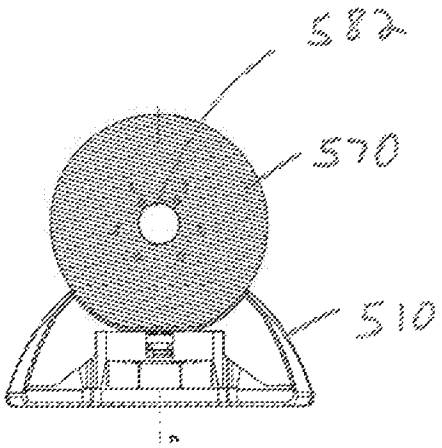
Figure 18E:
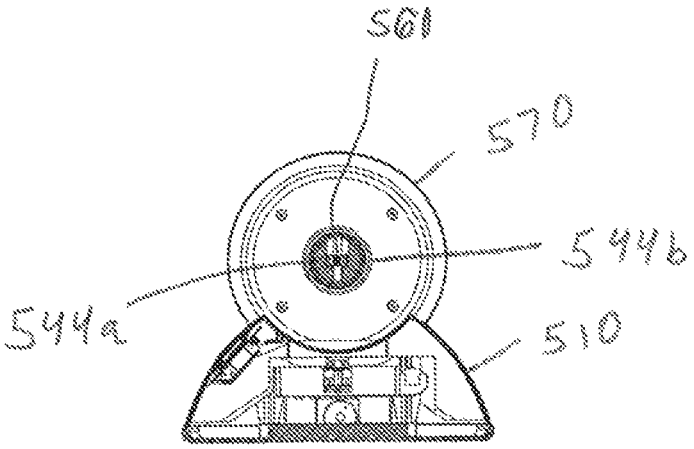
Figure 18F:
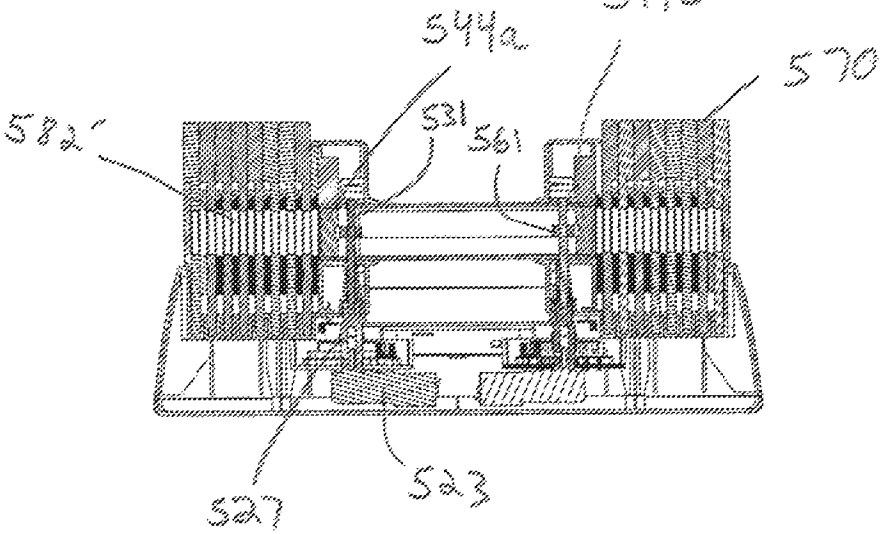

Weight 570 includes a female dovetail connector 590 on first side 581, and a male dovetail connector 580 on second side 583. The female dovetail connector 590 of a first weight 570 is configured to mate with a male dovetail connector 580 of a second weight 570*b* adjacent the first side 581 of the first weight, whereas the male dovetail connector 580 of the first weight 570 is configured to mate with a female dovetail connector 590 of a third weight 570 adjacent second side 583 of the first weight 570. FIG. 17 depicts the interconnection between the female dovetail connector 590 of weight 570*b* and male dovetail connector 580 of weight 570*a*. Various features in FIG. 17 are shown in a simplified form to facilitate understanding of the interconnection.

Male dovetail connector 580 and female dovetail connector 590 may be generally referred to herein as engagement surfaces. Those skilled in the art will recognize that other connector styles exist for accomplishing connection and disconnection between two bodies. Thus, connectors 580 and 590 may vary from that which is shown and described.

Figure 16A:
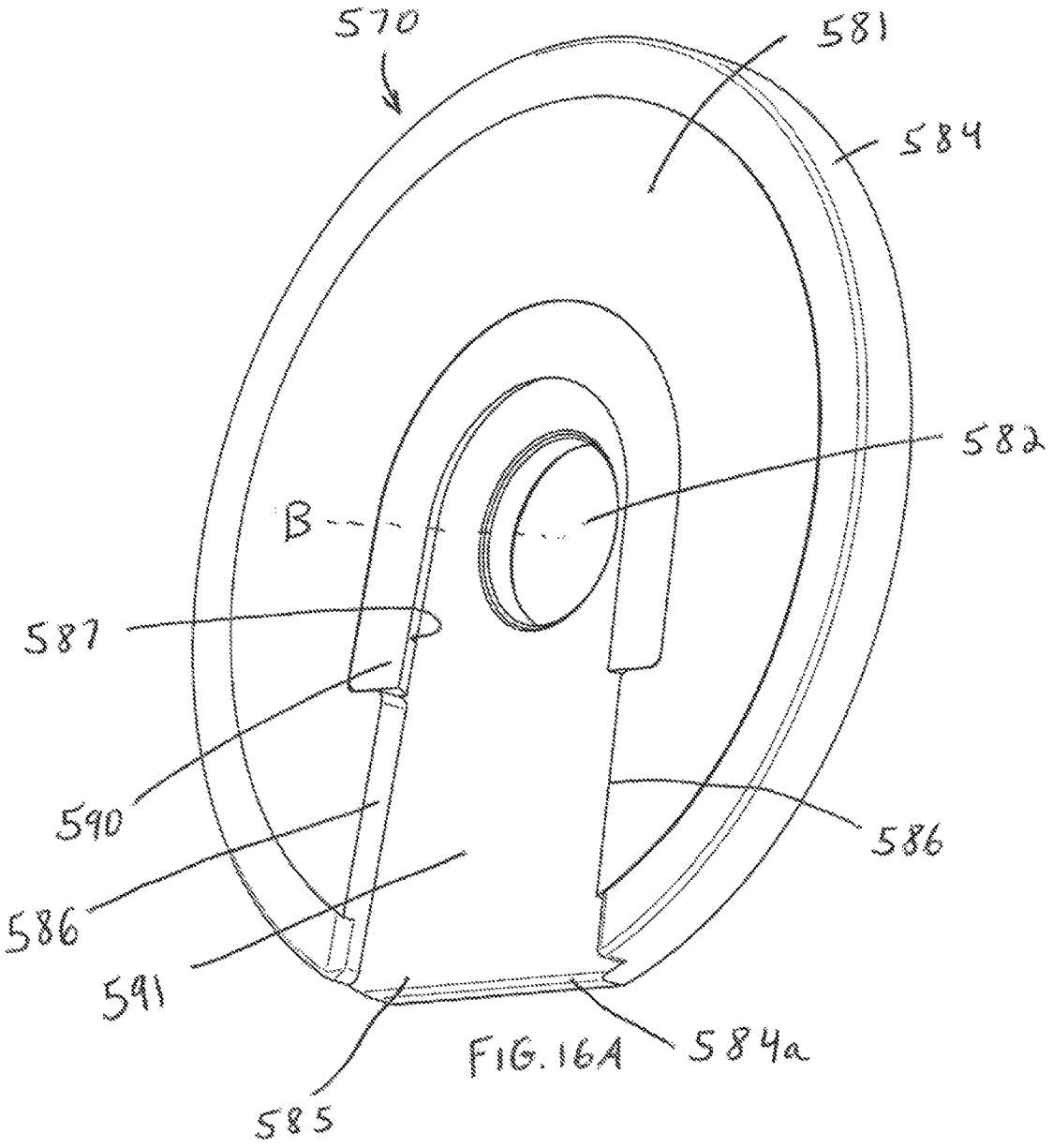
FIGS. 16A-16G depict isometric, front, rear, left, right, top and bottom views, respectively, of a weight of the device of FIGS. 14A-14G.
Figure 16B:
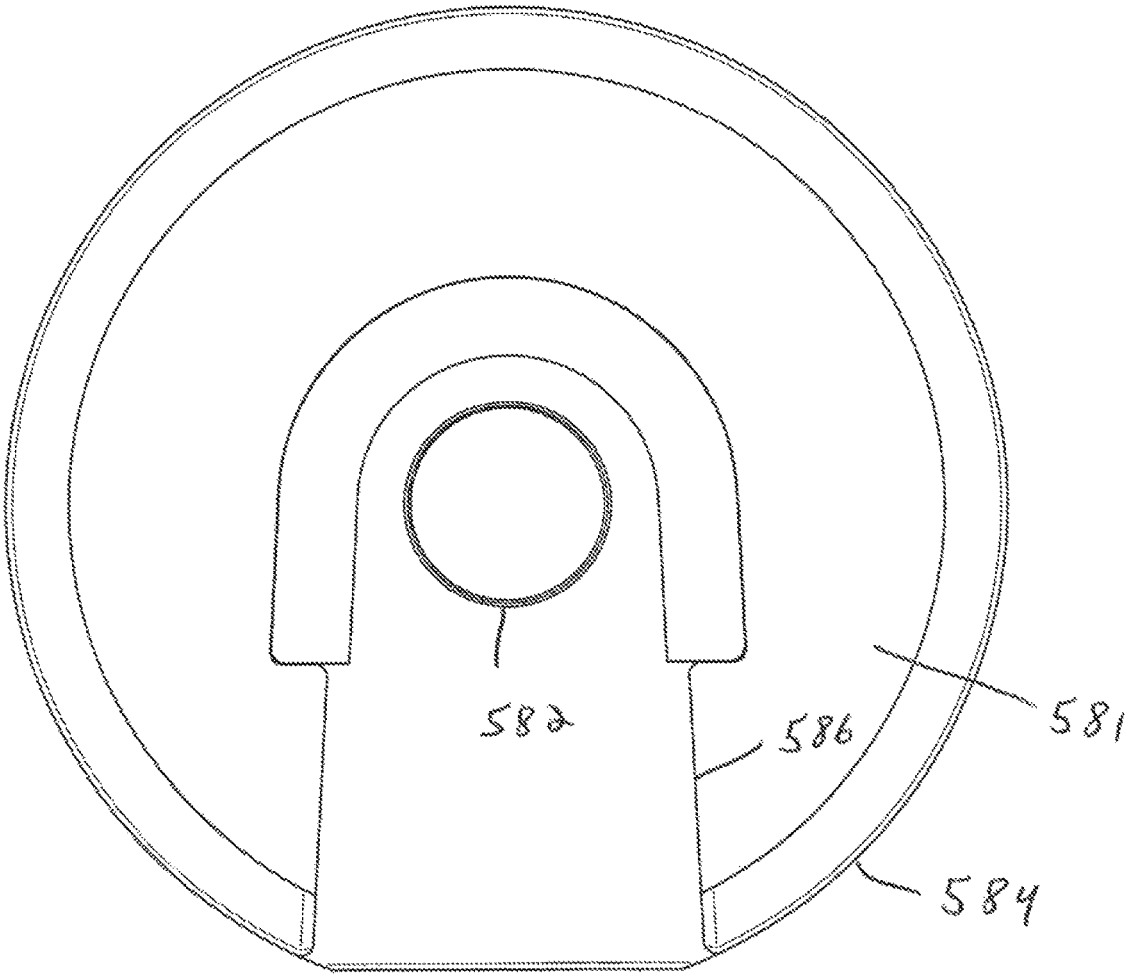
Figure 16C:
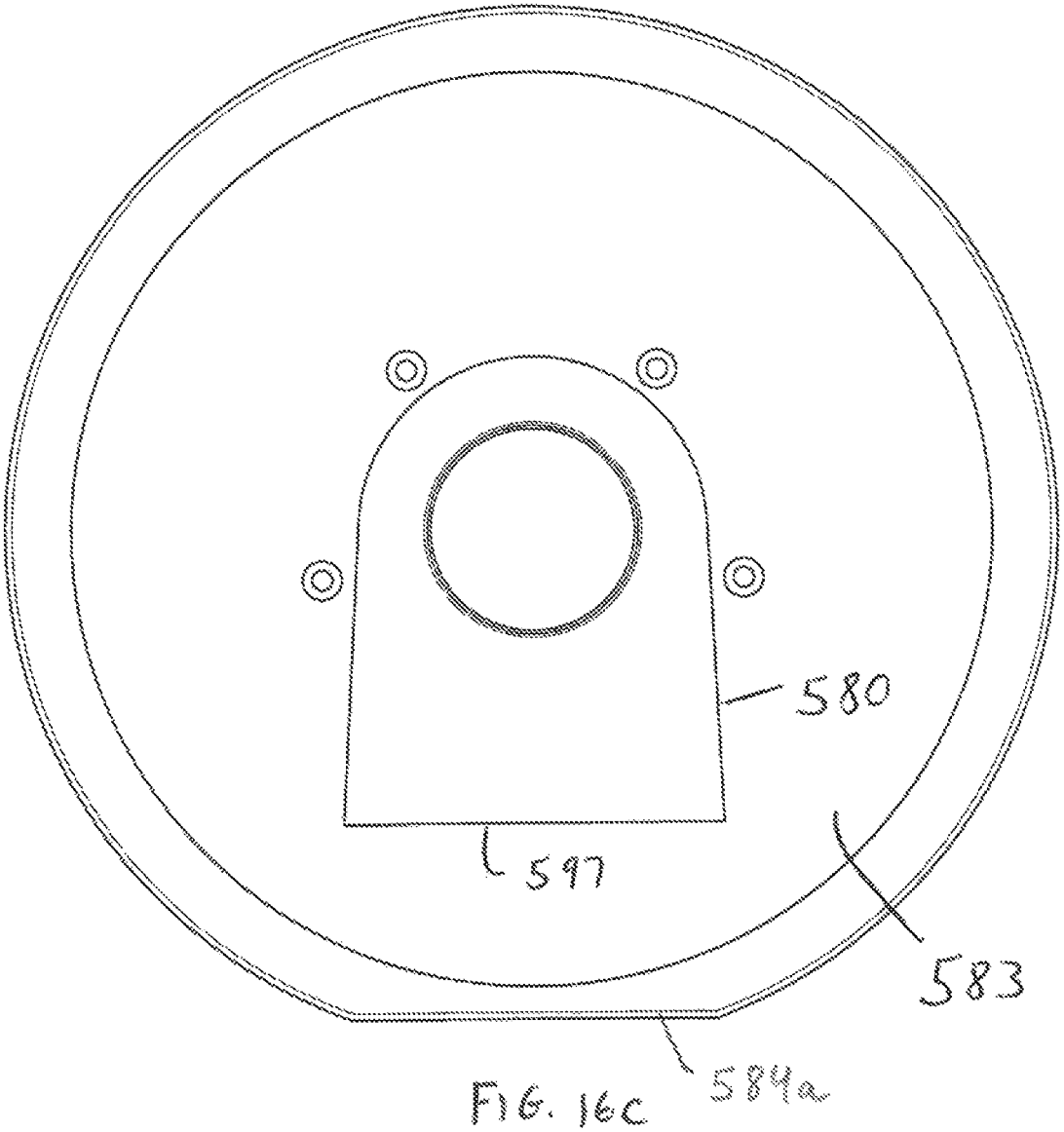

As best shown in FIG. 16A, side 581 of weight 570 includes a U-shaped cut-out portion extending from side 581 to planar surface 591. An opening 585 is formed at the base of the cut-out portion that intersects base 584*a* of weight 570. Upon docking the shell assembly 540 onto base assembly 510, the opening 585 is sized to first receive a male dovetail joint 580 of an adjacent weight 570 that is already docked on base assembly 510, and is also sized to thereafter receive one of the ribs 517 of housing 512. The shape of the opening 585 and rib 517 are complimentary to ensure that weight 517 can only be installed onto housing 512 in a single orientation thereby preventing improper installation of weights 517 onto housing 512.

Angled walls 586 extend in an A-shape. More particularly, angled walls 586 extend in a distal direction from the opposing ends of opening 585 and are slanted toward the longitudinal axis B of weight 570. In an assembled form of device 500, male dovetail connector 580 of an adjacent weight 570 is positioned between angled walls 586. Accordingly, angled walls 586 are configured to prevent rotation of an adjacent weight 570 that is mated thereto.

The female dovetail connector 590 extends between and connects the distal ends of the angled walls 586. The female dovetail connector 590 comprises a female dovetail surface 587 that extends about axis B. Female dovetail surface 587 is U-shaped about axis B and extends between and connects the distal ends of angled walls 586. Female dovetail surface 587 is also angled in a depth direction (i.e., along axis B) from first side 581 to second side 583 and both surrounds and faces the longitudinal axis B. As best seen in FIG. 16G, as viewed in a direction from first side 581 to second side 583 of weight 570, female dovetail surface 587 extends in an outward direction (e.g., at a 45 degree angle) leading away from longitudinal axis B of weight 570. As best shown in FIG. 17, female dovetail connector 590 of one weight 570*b* is designed to trap a mating male dovetail connector 580 of a mating weight 570*a* between the angled surface of female dovetail surface 587 and planar surface 591 of weight 570*a*.

Female dovetail connector 590 may form part of a separate insert that is fastened to first side 581 of weight 570 as shown in FIG. 16A, or, alternatively, female dovetail connector 590 may be unitized with first side 581 of weight 570 as shown in FIG. 17.

Figure 16D:
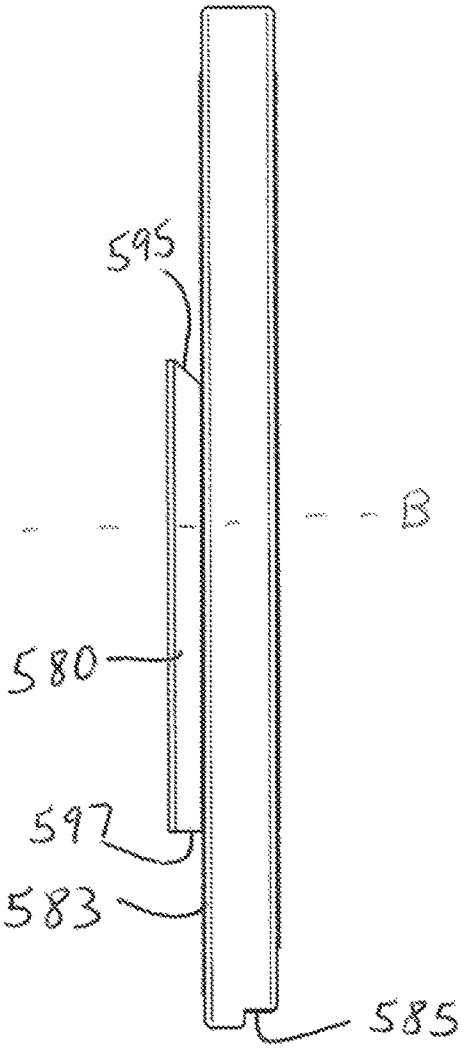
Figure 16E:
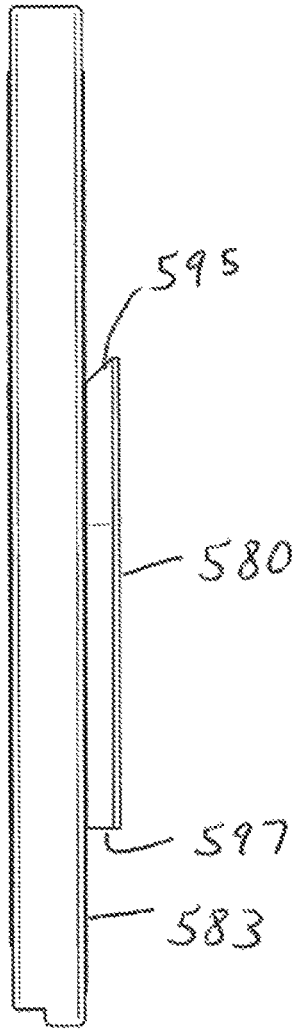
Figure 16F:
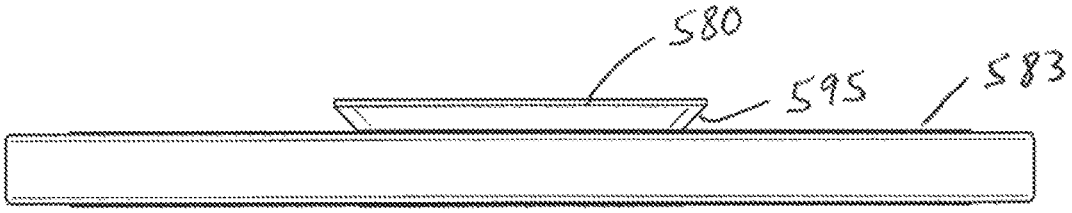
Figure 16G:
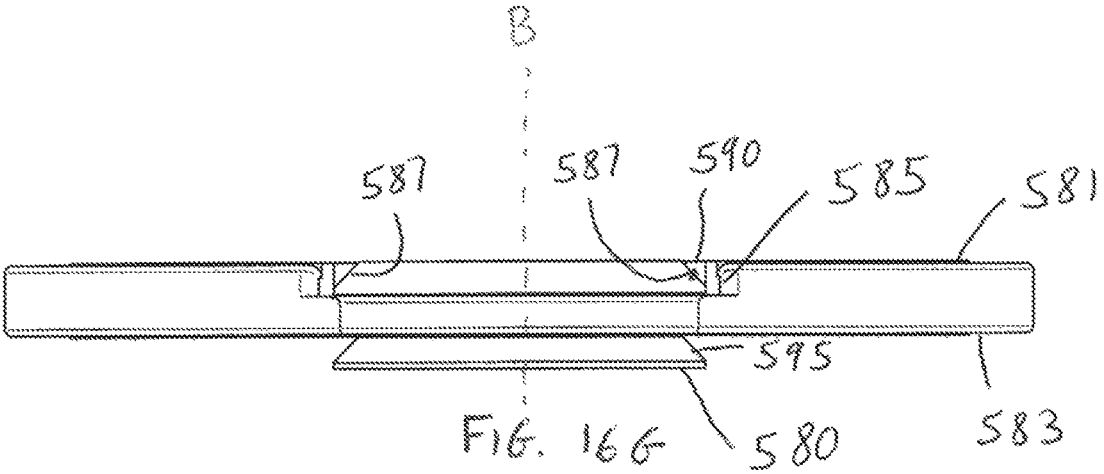

As best shown in FIGS. 16C-16G, side 583 of each weight 570 includes a male dovetail connector 580. Male dovetail connector 580 is a tombstone shaped protrusion that extends outwardly from side 583 along axis B. Male dovetail connector 580 includes a flat bottom surface 597 that is substantially parallel to base surface 584*a* of weight 570. A dovetail surface 595 extends from and connects the opposing ends of flat bottom surface 597. Dovetail surface 595 is U-shaped and surrounds axis B. As best shown in FIG. 16D, dovetail surface 595 extends outwardly at an acute angle (e.g. 45 degrees) from second side 583 and in a direction leading away from axis B. As best shown in FIG. 17, male dovetail surface 595 of one weight 570*a* is designed to be trapped between the angled surface of female dovetail surface 587 and planar surface 591 of a mating weight 570*b*.

Male dovetail connector 580 may form part of a separate insert that is fastened to second side 583 of weight 570, or, alternatively, male dovetail connector 580 may be unitized with second side 583 of weight 570.

The dovetail joint formed between female dovetail connector 590 and male dovetail connector 580 of two mated weights 570 prevents those mated weights from rotating about axis B with respect to each other. As shown in FIG. 17, the dovetail joint also prevents attached weight 570*a* from moving upward along axis A with respect to the other attached weight 570*b*. The dovetail joint does not prevent the attached weight 570*a* from moving downward or the attached weight 570*b* from moving upward—such translation is only prevented when one of the telescopic shafts 544 is positioned within openings 582 formed in the weights 570*a* and 570*b*. It should be understood that the stack of aligned openings 582 together form an aperture 582' through which the shaft 544 can travel. More particularly, when the telescopic shaft 544 is positioned within the openings 582 formed in the attached weights 570*a* and 570*b*, the attached weights 570*a* and 570*b* are prevented from detaching from each other. Stated differently, the dovetail joint provides one degree of freedom for two weights 570 that are mated together, and that one degree of freedom is eliminated once telescopic shaft 544 is positioned within the openings 582 in those weights.

Operation of device 500 will now be described with reference to FIGS. 14A, 14G, 18F and 17. Operation of device 500 is similar to that of the device 100, and the primary differences will be described hereinafter.

As best shown in FIG. 14A, in an assembled and docked state of device 500, weights 570 are nested together and positioned on base assembly 510. In the nested state, all of the weights 570 are interconnected together, as at least partially shown in FIG. 17, such that the weights 570 are prevented from rotating relative to one another by the mating geometries of male dove connectors 580 and female dove connectors 590.

In the docked state of device 500, shell assembly 540 is docked on base assembly 510, and the spring pins 557 on shell assembly 540 are positioned in direct physical contact with electrical contacts 559 on the top surface of base assembly 510. Power and signals are passed between spring pins 557 and electrical contacts 559. More particularly, signals corresponding to readings of sensor 552 are transmitted from the PCB of shell assembly 540 to spring pins 557, to electrical contacts 559 and to PCB 541 of base assembly 510 such that the readings of sensor 552 are uploaded to the memory of base assembly 510. Also, power is transmitted from PCB 541 of base assembly 510 then to electrical contacts 559 then to spring pins 557 then to the PCB of shell assembly 540 and then to the rechargeable battery of shell assembly 540 for recharging the rechargeable battery. The rechargeable battery provides power to the sensor 552 of shell assembly 540 as well as any other components of shell assembly 540 requiring power. As a result of the interconnection between the spring pins 557 and electrical contacts 559, the PCB 541 of base assembly 510 understands that shell assembly 540 is docked on base assembly 510. If electrical contacts 559 on base assembly 510 do not receive signals from spring pins 557, then base assembly 510 understands that shell assembly 540 is removed from base assembly 510, and base assembly 510 will not operate motors 523 in response to a user depressing buttons 521. The above described communication and electrical interface between shell assembly 540 and base assembly 510 is also applicable to shell assembly 140 and base assembly 110 of device 100.

Before device 500 is used, a user first selects the amount of desired weight for a particular exercise routing using device 500 by depressing one of buttons 521 on base assembly 510 while shell assembly 540 is docked on base assembly 510. Depressing one of buttons 521 causes the desired weight to display on display 519, and also causes motors 523 to activate and rotate their output shafts 525 in the same direction. Rotating output shafts 525 causes rotation of shafts 531 and their toothed gears 561. Toothed gears 561 rotate about their axes in the same direction, which causes telescopic shafts 544 to either translate outwardly along axis B (i.e., away from handle 542) or translate inwardly along axis B (i.e., toward handle 542) due to the geared arrangement between toothed gears 561 and gear teeth 572 of telescopic shafts 544.

More particularly, if a user selects a "–" button 521 indicating a desire to use less weight than was previously used and displayed on display 519, then the gears 561 rotate in a direction to cause telescopic shafts 544 to translate inwardly and in opposite directions along axis B (i.e., toward handle 542). Telescopic shafts 544 move a discrete distance along axis B and disengage from the openings 582 in one or more weights 570. The distance travelled by shafts 544, which is caused by rotation of motors 523, is controlled by the processor on PCB 541 of base assembly 510. The distance travelled by shafts 544 is directly proportional to the weight selected by the user using button 521.

Once telescopic shafts 544 disengage from an opening 582 in a weight 570, then that weight 570 will detach from shell assembly 540 once shell assembly 540 is removed from base assembly 510. In other words, that weight 570 will remain docked on base assembly 510 once shell assembly 540 is removed from base assembly 510. For example, with reference to FIG. 17, if a telescopic shaft 544 is initially engaged with both weights 570*a* and 5706, and the telescopic shaft 544 is translated such that it is no longer positioned within opening 582 of weight 570*a*, then when the user removes the shell assembly 540 from base assembly 510, weight 570*b* will be attached to shell assembly 540 while weight 570*a* will remain docked on base assembly 510. Stated differently, the dovetail joint is configured to permit adjacent weights to become detached when a shaft 544 is not positioned within an opening 582 in one of those weights.

The user then removes shell assembly 540 along with weights 570 attached thereto and performs an exercise routine. Once electrical contacts 559 of base assembly 510 become detached from spring contacts 557 of shell assembly 540, the processor of base assembly 510 knows that shell assembly 540 has been removed from base assembly 510 and an exercise routine is underway.

Alternatively, if a user selects a "+" button 521 indicating a desire to use more weight than was previously used and displayed on display 519, then the gears 561 rotate to cause telescopic shafts 544 to translate outwardly along axis B (i.e., away from handle 542). Telescopic shafts 544 move a discrete distance along axis B and engage with the openings 582 in one or more additional weights 570. The distance travelled by shafts 544, which is caused by rotation of motors 523, is controlled by the processor on PCB 541 of base assembly 510. The distance travelled by shafts 544 is directly proportional to the weight selected by the user. Once telescopic shafts 544 engage an opening 582 in a weight 570, then that weight 570 cannot be detached from shell assembly 540 once shell assembly 540 is removed from base assembly 510. The user then removes shell assembly 540 along with weights 570 attached thereto and performs an exercise routine.

As another alternative, if the user does not desire to change the amount of weight than was previously used and displayed on display 519, then the user can simply remove shell assembly 540 (along with weights 570 that are connected thereto) from base assembly 510 and begin an exercise routine using shell assembly 540 and any weights 570 that are connected thereto.

Following the exercise routine, the user returns the shell assembly 540 to base assembly 510 (i.e., docks shell assembly 540). Upon returning the shell assembly 540 to base assembly 510, the openings 585 in the outermost weights attached to shell assembly 540, travel over the male dovetail connectors 580 on the innermost weights 570 that are docked on base assembly 510. Further downward translation of shell assembly 540 causes the lower end of each shaft 531 on shell assembly 540 to engage in a respective opening 529 on intermediate shaft 527 of base assembly 510. Spring contacts 557 then physically engage electrical contacts 559 on base assembly 510.

Once the shell assembly 540 is docked on the base assembly 510, data is transmitted from the PCB of the shell assembly 540 to PCB 541 of base assembly 510 due to the interconnection of contacts 557 and 559. The base assembly 510 is configured to interpret and/or transmit that data via the wireless transmitter/receiver of PCB 541 to a remote device, such as a smart phone or a computer. The data contains information related to the amount of weight used in an exercise routine, the number of curls, reps or motions in the exercise routine (as measured by accelerometer of shell assembly 540) and the time duration of the exercise routine, for example. The smart phone or computer contains a program that is configured to track the data for each exercise routine.

While preferred embodiments of the invention have been shown and described herein, it will be understood that such embodiments are provided by way of example only. Numerous variations, changes and substitutions will occur to those skilled in the art without departing from the spirit or principle of the invention. Accordingly, it is intended that the appended claims cover all such variations as fall within the spirit, scope, or principle of the invention.

What is claimed:

1. An exercise device comprising:

a plurality of weights configured to be positioned adjacent one another;

a shell assembly having a shell defining an interior, the shell assembly also having a shaft coupled for movement relative to the shell and extending within the interior of the shell, wherein movement of the shaft relative to the shell selectively couples the shaft with one or more of the plurality of weights;

a base assembly having a base configured to support the plurality of weights and the shell assembly, the base assembly also having a driver configured to be coupled to the shaft of the shell assembly when the shell assembly is supported by the base, the driver also being configured to be decoupled from the shaft of the shell assembly when the shell assembly is not supported by the base, wherein the driver of the base assembly is configured to move the shaft of the shell assembly relative to the shell of the shell assembly when the driver is coupled to the shaft of the shell assembly to selectively couple the shaft with the one or more of the plurality of weights; and a drive shaft coupled to the driver and to the shaft of the shell assembly when the shell assembly is supported by the base assembly, the drive shaft being configured for rotation to move the shaft relative to the shell of the shell assembly when the drive shaft is coupled to the shaft of the shell assembly.

2. The exercise device of claim 1, wherein each of the plurality of weights has an opening, the openings of the plurality of weights at least in part defining an aperture extending along an axis when the plurality of weights are adjacent one another, and wherein the shaft of the shell assembly is positionable within the aperture defined by the plurality of weights.

3. The exercise device of claim 2, wherein each of the plurality of weights includes one or more engagement surfaces, and wherein movement of the shaft relative to the shell by the driver causes the shaft to selectively engage with one or more of the plurality of weights to limit or prevent movement of the one or more of the plurality of weights along a direction orthogonal to the axis of the aperture.

4. The exercise device of claim 1, wherein at least two weights of the plurality of weights are configured to be placed adjacent one another along an axis of the plurality of weights to form a pair of weights, a first weight of the pair of weights including a male surface and a second weight of the pair of weights including a female surface configured to be engaged by the male surface of the first weight, thereby limiting or eliminating movement of the first weight and the second weight of the pair of weights relative to one another along the axis.

5. The exercise device of claim 4, wherein the first weight and the second weight of the pair of weights each defines an aperture extending along the axis to receive the shaft of the shell assembly to selectively couple the shaft with the first weight and the second weight, the shaft limiting or eliminating movement of the first weight and the second weight of the pair of weights relative to one another in a direction orthogonal to the axis.

6. The exercise device of claim 1, wherein the driver comprises a motor, and the base assembly further comprises a controller that electrically controls the motor to move the shaft based on an input from a user of the exercise device, and wherein the base assembly further comprises an input device which is electrically or mechanically coupled to the driver to cause the driver to rotate the shaft based on input from the user of the exercise device.

7. The exercise device of claim 1, wherein the shell assembly further comprises a handle portion positioned to be grasped by a user of the exercise device, and wherein the handle portion is provided along the shell of the shell assembly and defines a handle axis, each of the plurality of weights extending radially outwardly from a weight axis oriented parallel to the handle axis.

8. The exercise device of claim 1, wherein the drive shaft is positioned to extend into an interior of the shell assembly when the driver is coupled to the shaft of the shell assembly and the shell assembly is supported by the base, and wherein the drive shaft is oriented orthogonally relative to a shaft axis of the shaft of the shell assembly.

9. An exercise device comprising:

a plurality of weights configured to be positioned adjacent one another;

a shell assembly having a shell defining an interior, the shell assembly also having plural shafts each coupled for movement relative to the shell and extending within the interior of the shell, wherein movement of the plural shafts relative to the shell selectively couples the plural shafts with one or more of the plurality of weights;

a base assembly having a base configured to support the plurality of weights and the shell assembly, the base assembly also having plural drivers configured to be respectively coupled to the plural shafts of the shell assembly when the shell assembly is supported by the base, the plural drivers also being configured to be decoupled from the plural shafts of the shell assembly when the shell assembly is not supported by the base;

wherein the plural drivers of the base assembly are configured to respectively move the plural shafts of the shell assembly relative to the shell of the shell assembly when the plural drivers are respectively coupled to the plural shafts of the shell assembly to selectively couple the plural shafts with the one or more of the plurality of weights, wherein the exercise device is selected from the group consisting of a dumbbell and a barbell, wherein the plurality of weights are arranged in plural groups, the plural groups being positioned on opposite sides of the shell assembly, wherein movement of the plural shafts relative to the shell selectively couples the plural shafts with one or more weights in each of the plural groups of plurality of weights, and wherein movement of the plural shafts relative to the shell selectively couples the plural shafts with an equal number of weights in each of the groups of weights, wherein the shell assembly includes a handle shaft and shell sub-assemblies, each coupled to a respective end portion of the handle shaft, wherein each of the shell sub-assemblies at least partially defines an interior region of the interior of the shell, and wherein the exercise device further comprises drive shaft assemblies, each configured to be driven by one of the plural drivers and positioned at least partially within the interior region of each of the shell sub-assemblies, each of the drive shaft assemblies including a drive shaft surface positioned for engagement with a respective one of the plural shafts.

10. The exercise device of claim 9, each of the drive shaft assemblies being releasably couplable to a respective one of the plural drivers.

11. The exercise device of claim 9, each of the plural shafts having a gear rack, and the drive shaft surface of each of the drive shaft assemblies including a gear engaged with the gear rack of a respective one of the plural shafts.

12. An exercise device comprising:

a plurality of weights configured to be positioned adjacent one another;

a shell assembly having a shell defining an interior, the shell assembly also having a shaft coupled for movement relative to the shell and extending within the interior of the shell, wherein movement of the shaft relative to the shell selectively couples the shaft with one or more of the plurality of weights;

a base assembly having a base configured to support the plurality of weights and the shell assembly, the base assembly also having a driver configured to be coupled to the shaft of the shell assembly when the shell assembly is supported by the base, the driver also being configured to be decoupled from the shaft of the shell assembly when the shell assembly is not supported by the base;

wherein the driver of the base assembly is configured to move the shaft of the shell assembly relative to the shell of the shell assembly when the driver is coupled to the shaft of the shell assembly to selectively couple the shaft with the one or more of the plurality of weights, wherein the shell assembly includes a memory configured to store data corresponding to movement of the shell assembly, wherein the base assembly includes a memory configured to receive the data corresponding to movement of the shell assembly, and wherein the base assembly and the shell assembly are configured to share the data corresponding to movement of the shell assembly when the base assembly is supporting the shell assembly.

13. The exercise device of claim 12, the base assembly being configured to wirelessly transmit the data corresponding to movement of the shell assembly to a remote device.

* * * * *